US011135633B2

(12) United States Patent
Tanaka et al.

(10) Patent No.: US 11,135,633 B2
(45) Date of Patent: Oct. 5, 2021

(54) METHOD AND APPARATUS FOR PRODUCING PRESSED COMPONENT

(71) Applicant: NIPPON STEEL & SUMITOMO METAL CORPORATION, Tokyo (JP)

(72) Inventors: Yasuharu Tanaka, Tokyo (JP); Toshimitsu Aso, Tokyo (JP); Takashi Miyagi, Tokyo (JP); Misao Ogawa, Tokyo (JP); Shinobu Yamamoto, Tokyo (JP); Keita Ikegami, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 175 days.

(21) Appl. No.: 16/313,451

(22) PCT Filed: Jun. 26, 2017

(86) PCT No.: PCT/JP2017/023450
§ 371 (c)(1),
(2) Date: Dec. 26, 2018

(87) PCT Pub. No.: WO2018/003755
PCT Pub. Date: Jan. 4, 2018

(65) Prior Publication Data

US 2019/0160510 A1 May 30, 2019

(30) Foreign Application Priority Data

Jun. 27, 2016 (JP) ..... JP2016-126247

(51) Int. Cl.
*B21D 22/26* (2006.01)
*B21D 24/04* (2006.01)
(Continued)

(52) U.S. Cl.
CPC ..... *B21D 22/26* (2013.01); *B21D 5/002* (2013.01); *B21D 5/04* (2013.01); *B21D 5/06* (2013.01);
(Continued)

(58) Field of Classification Search
CPC ..... B21D 22/26; B21D 22/20; B21D 22/06; B21D 22/22; B21D 22/02; B21D 22/10;
(Continued)

(56) References Cited

U.S. PATENT DOCUMENTS

2005/0262917 A1 12/2005 Osumi et al.
2011/0100085 A1 5/2011 Kubo
(Continued)

FOREIGN PATENT DOCUMENTS

CN 102131598 A 7/2011
CN 102791396 A 11/2012
(Continued)

OTHER PUBLICATIONS

Translation of JP-2551022-B2 (Year: 1996).*
(Continued)

*Primary Examiner* — Teresa M Ekiert
*Assistant Examiner* — Teresa A Guthrie
(74) *Attorney, Agent, or Firm* — Birch, Stewart, Kolasch & Birch, LLP

(57) ABSTRACT

A method or apparatus to produce an L-shaped pressed component includes, where a portion of a blank, having tensile strength of 1180 MPa or more, is held in a state of being clamped by a blank holder and a die, and a portion of the blank, to be formed into a top plate is held in a state of being clamped by a pad and a punch; the second step where a vertical wall, a concave ridge and a flange on the inner side of a curved portion are formed by, bend forming with a bending die, forming one, two or more material inflow
(Continued)

promoting portion; and the third step where the die is moved in a direction toward a side where the blank holder is disposed to form a vertical wall, a concave ridge, and a flange on the outer side of the curved portion by draw forming.

8 Claims, 22 Drawing Sheets

(51) Int. Cl.

| | |
|---|---|
| ***B21D 24/12*** | (2006.01) |
| ***B21D 22/20*** | (2006.01) |
| ***B21D 5/00*** | (2006.01) |
| ***B21D 5/04*** | (2006.01) |
| ***B21D 5/06*** | (2006.01) |
| ***B21D 25/04*** | (2006.01) |

(52) U.S. Cl.
CPC ..... *B21D 22/20* (2013.01); *B21D 24/04* (2013.01); *B21D 24/12* (2013.01); *B21D 25/04* (2013.01)

(58) Field of Classification Search
CPC ..... B21D 22/24; B21D 22/00; B21D 5/002; B21D 5/04; B21D 5/06; B21D 24/04; B21D 24/12; B21D 25/04
USPC ..... 72/347
See application file for complete search history.

(56) References Cited

U.S. PATENT DOCUMENTS

| | | | | |
|---|---|---|---|---|
| 2012/0297853 | A1 | 11/2012 | Tanaka et al. | |
| 2013/0239645 | A1 | 9/2013 | Tanaka et al. | |
| 2015/0298193 | A1 | 10/2015 | Urabe | |
| 2015/0336619 | A1* | 11/2015 | Tanaka | B62D 25/04 296/193.06 |
| 2015/0343514 | A1* | 12/2015 | Inoue | B23K 31/02 228/173.7 |
| 2016/0082495 | A1 | 3/2016 | Miyagi et al. | |
| 2016/0158821 | A1 | 6/2016 | Fuji et al. | |

FOREIGN PATENT DOCUMENTS

| | | | | |
|---|---|---|---|---|
| CN | 103237611 | A | 8/2013 | |
| CN | 204035335 | U | 12/2014 | |
| CN | 104870117 | A | 8/2015 | |
| CN | 104870118 | A | 8/2015 | |
| CN | 105392575 | A | 3/2016 | |
| EP | 2942123 | A1 | 11/2015 | |
| JP | 64-66024 | A | 3/1989 | |
| JP | 2551022 | B2 * | 11/1996 | |
| JP | 2006-15404 | A | 1/2006 | |
| JP | 2013-35068 | A | 2/2013 | |
| RU | 2 116 854 | C1 | 8/1998 | |
| RU | 81932 | U1 | 4/2009 | |
| SU | 1196076 | A | 12/1985 | |
| WO | WO 2014/106932 | A1 | 7/2014 | |
| WO | WO-2014106932 | A1 * | 7/2014 | B21J 5/02 |
| WO | WO 2014/185428 | A1 | 11/2014 | |

OTHER PUBLICATIONS

Russian Office Action and Search Report dated Aug. 15, 2019, for corresponding Russian Patent Application No. 2019101905, with English translation.
Korean Office Action dated Mar. 18, 2020, issued for corresponding Korean Patent Application 10-2019-7002555.
Extended European Search Report for European Application No. 17820110.9, dated Feb. 13, 2020.
Chinese Office Action and Search Report dated Sep. 23, 2019, for corresponding Chinese Application No. 201780040282.X, with partial English translation.
International Search Report for PCT/JP2017/023450 (PCT/ISA/210) dated Sep. 19, 2017.

* cited by examiner

[Fig.1]
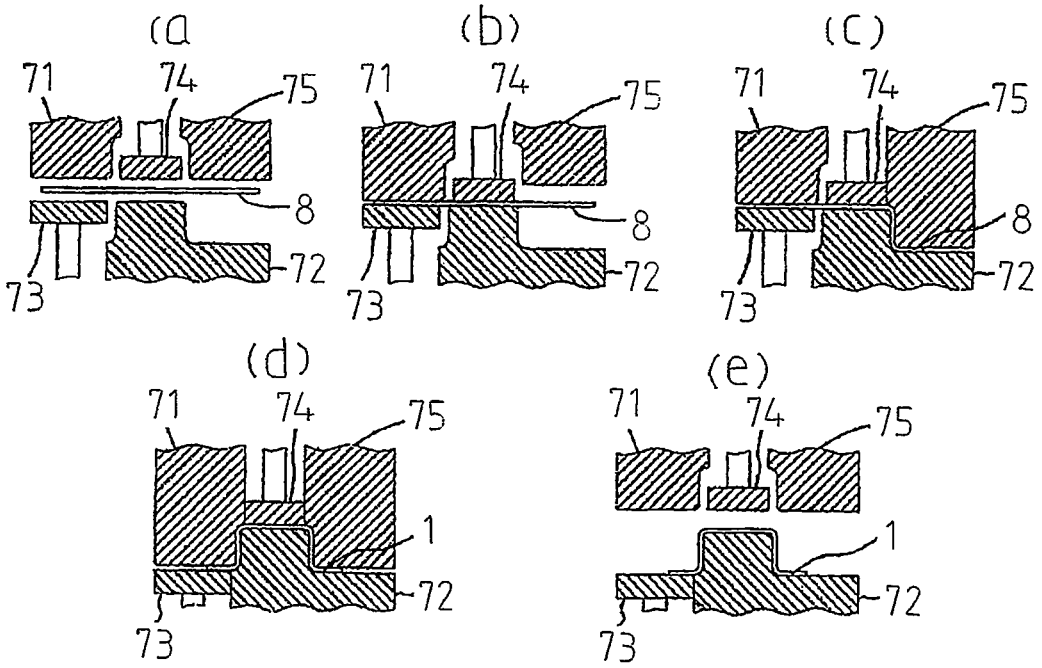
[Fig.2]
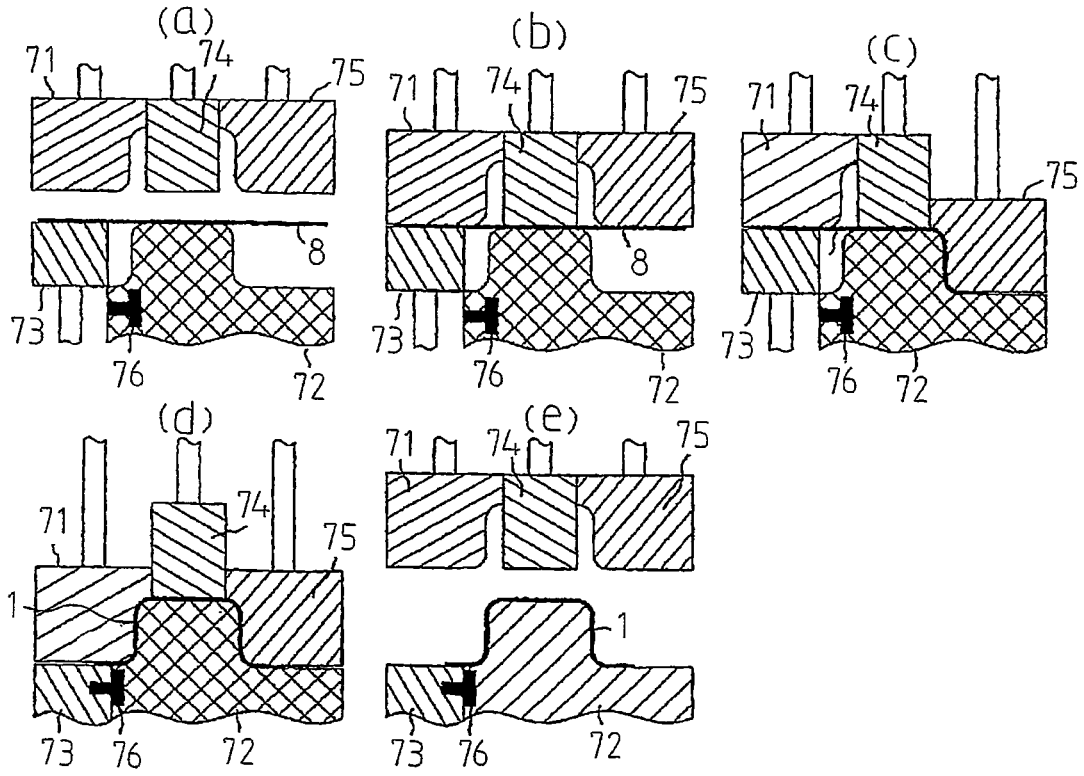

[Fig.2A]
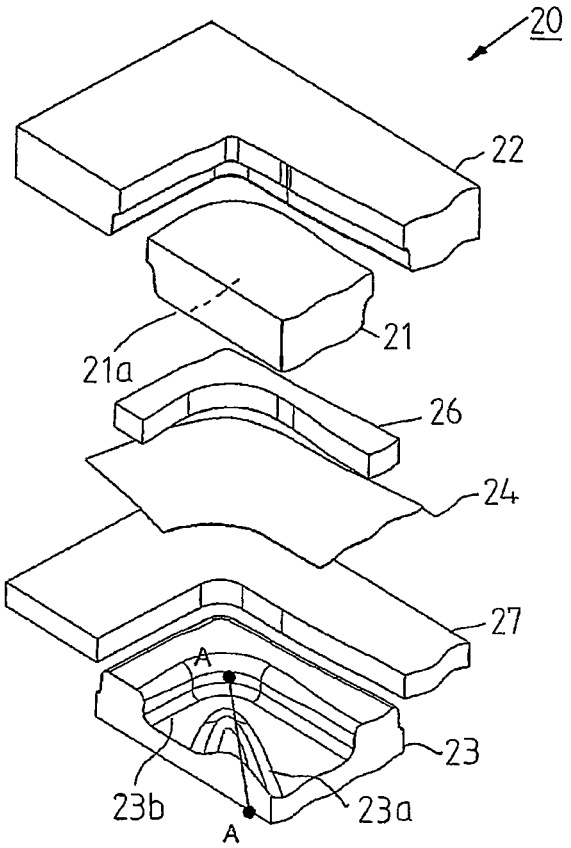
[Fig.2B]
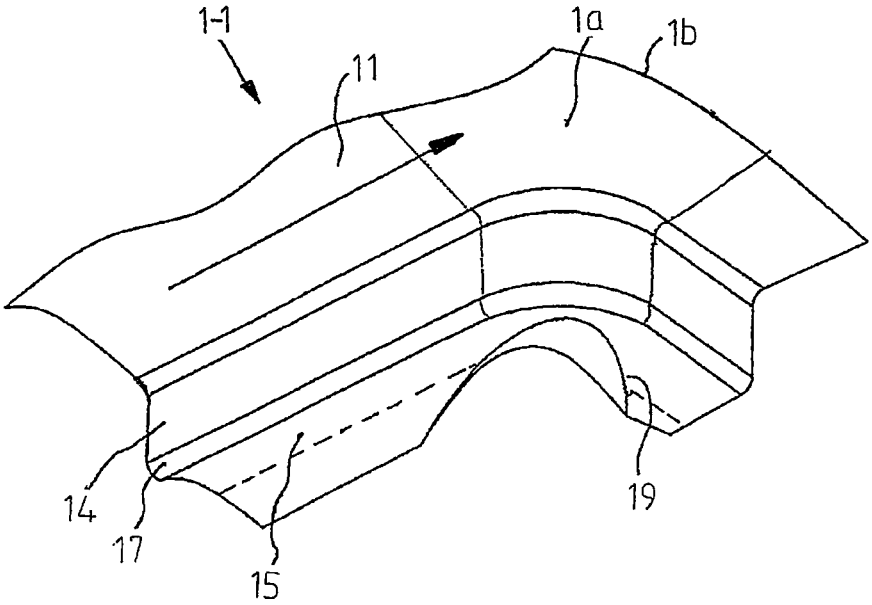

[Fig.2C]
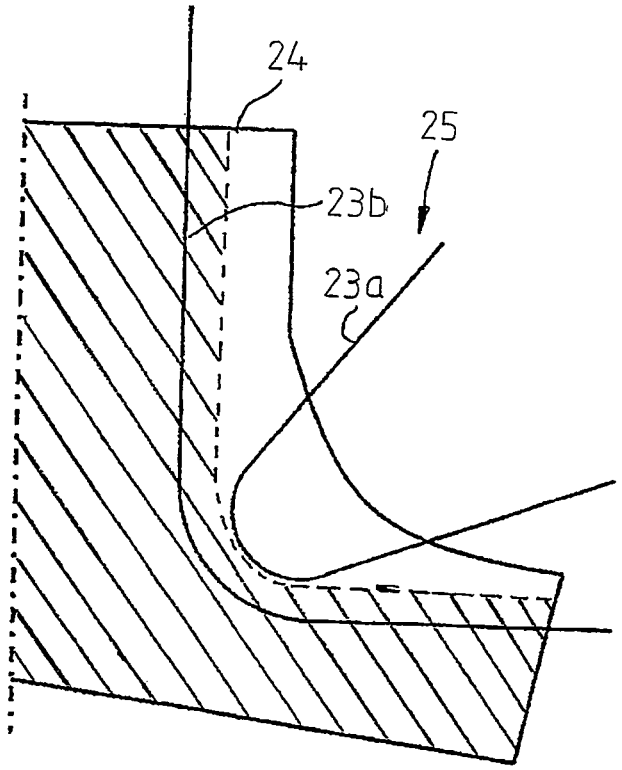
[Fig.2D]
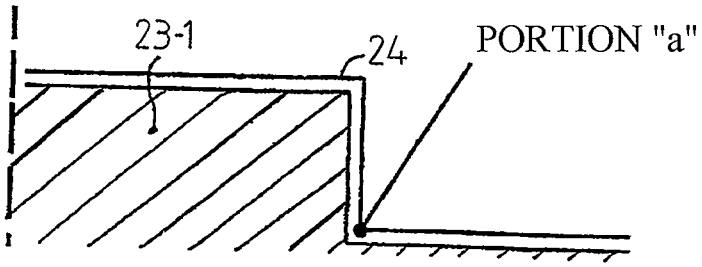

[Fig.2E]
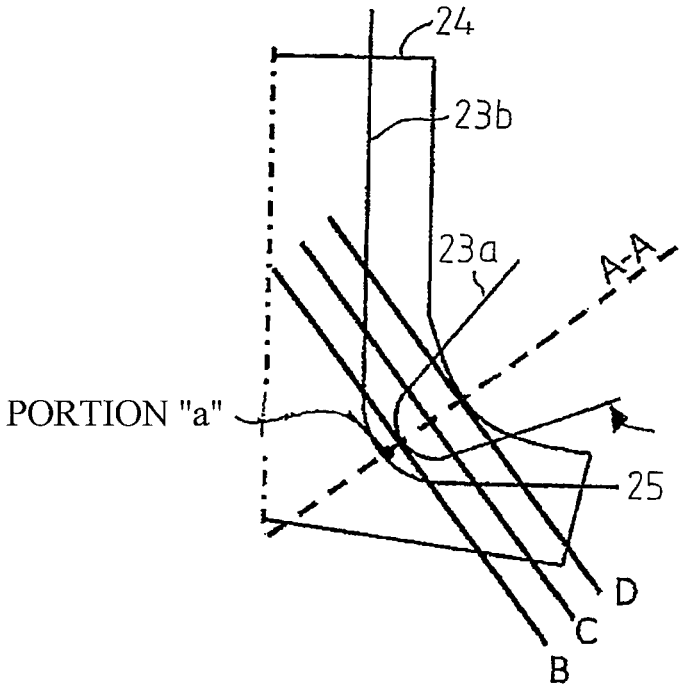
[Fig.2F]
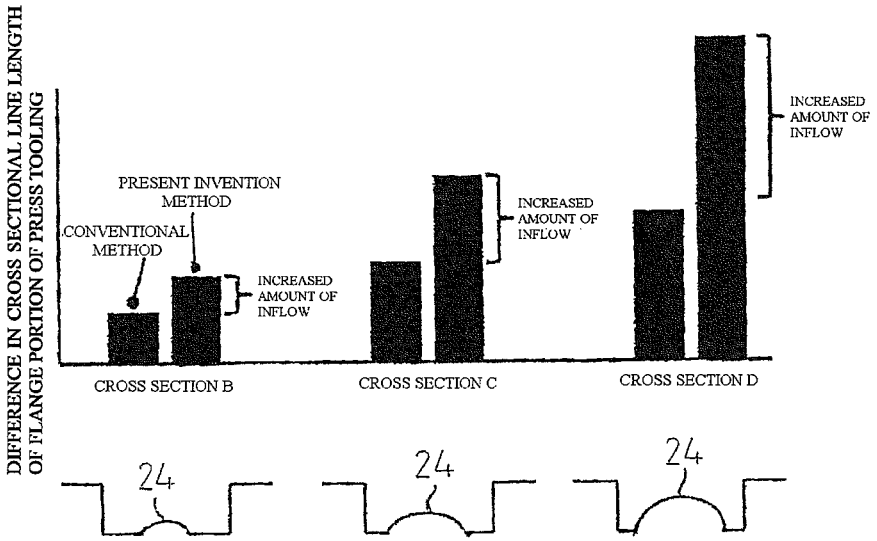

[Fig.2G]
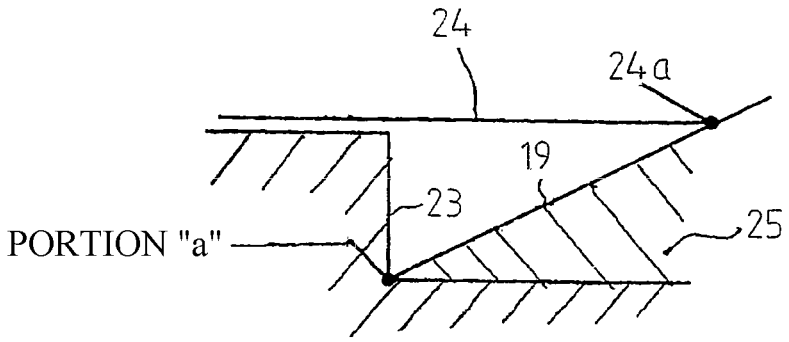
[Fig.2H]
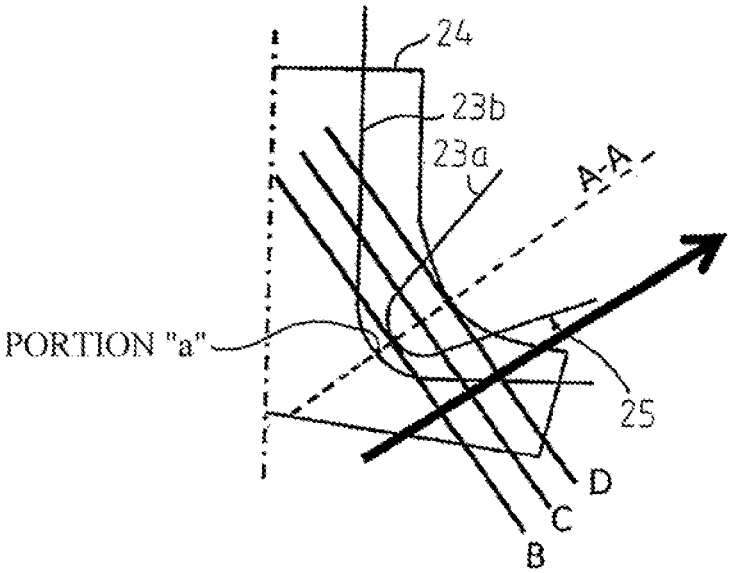

[Fig.2I]
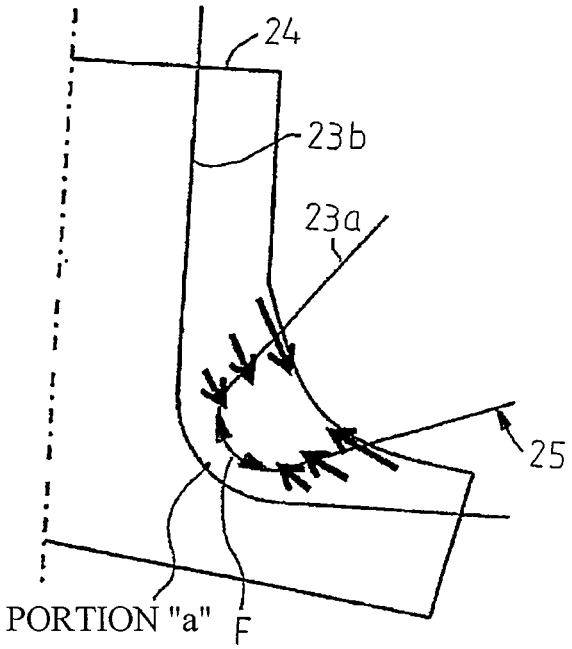

[Fig.2J]
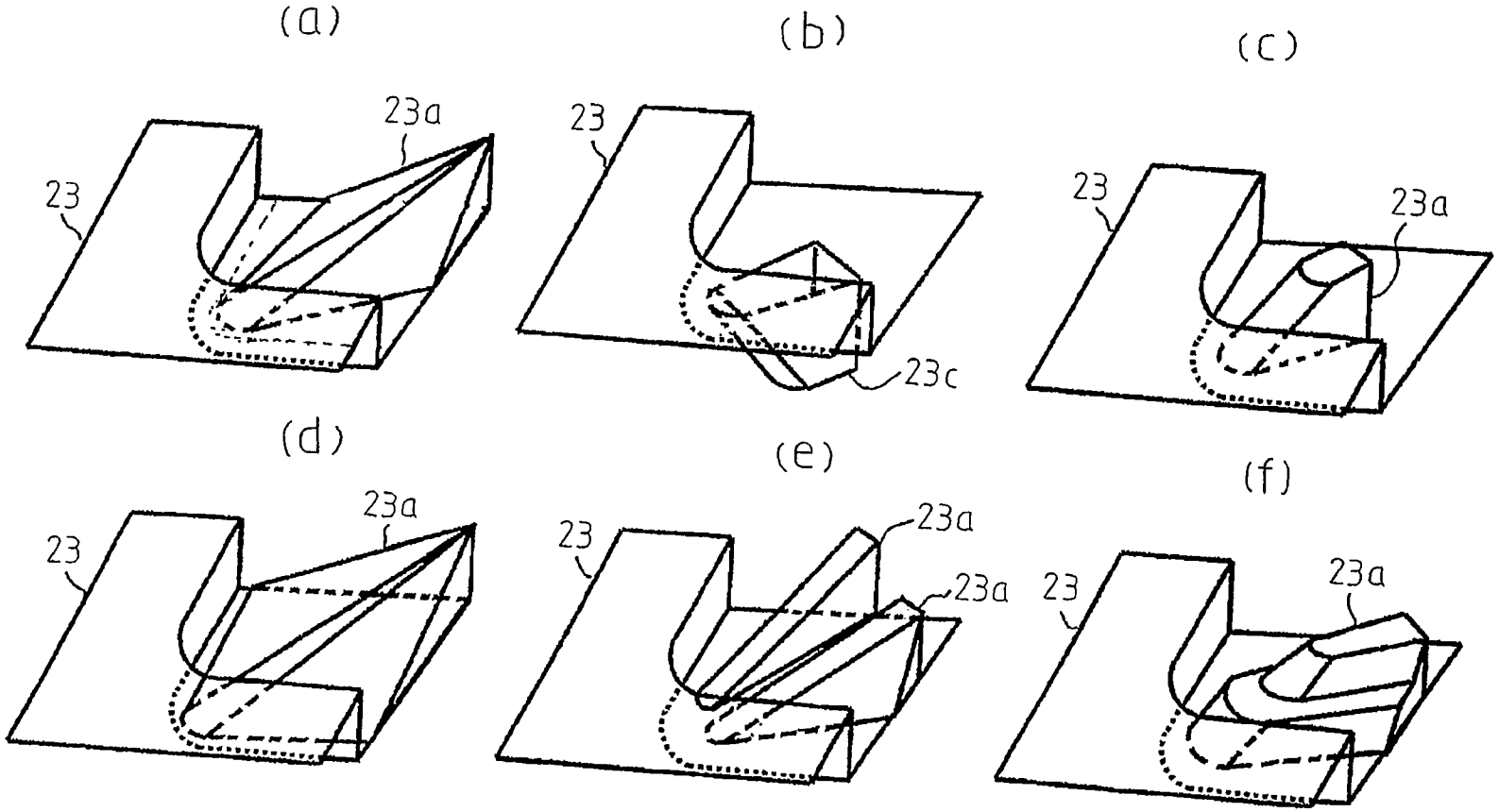

[Fig.3]
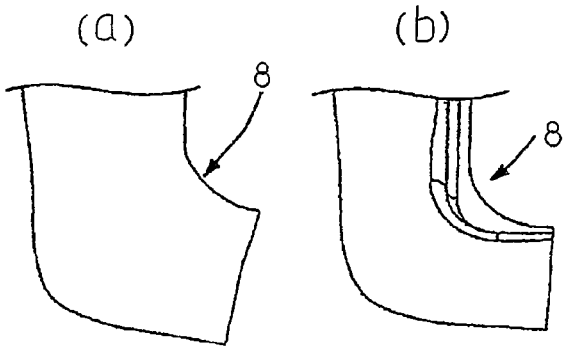
[Fig.4]
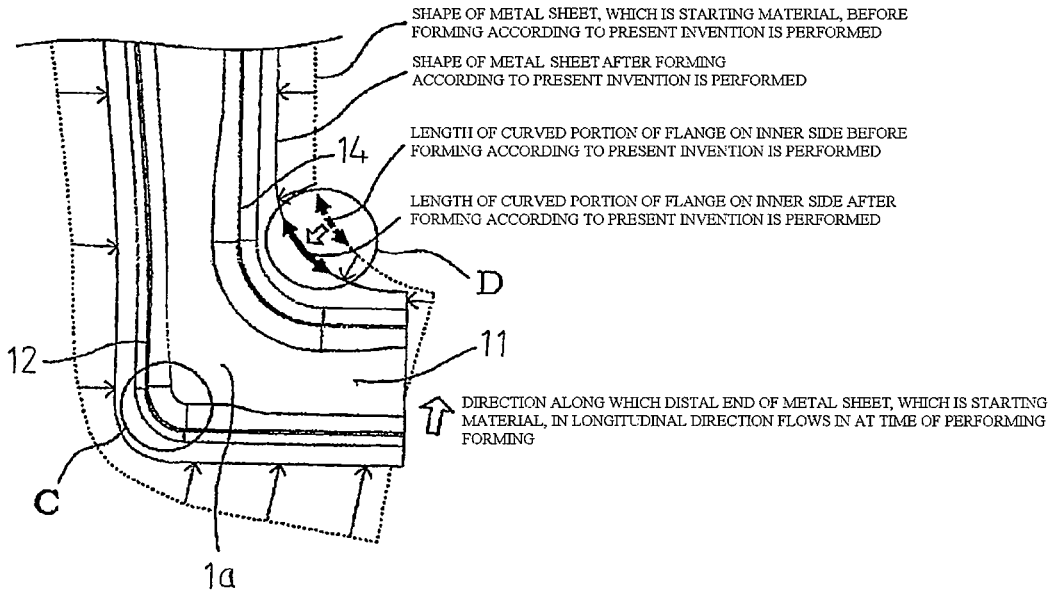

[Fig.5]
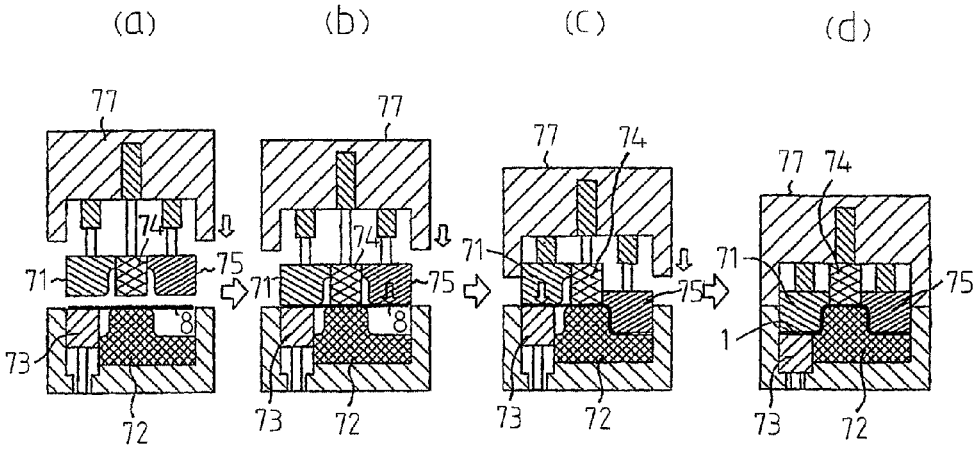
[Fig.6]
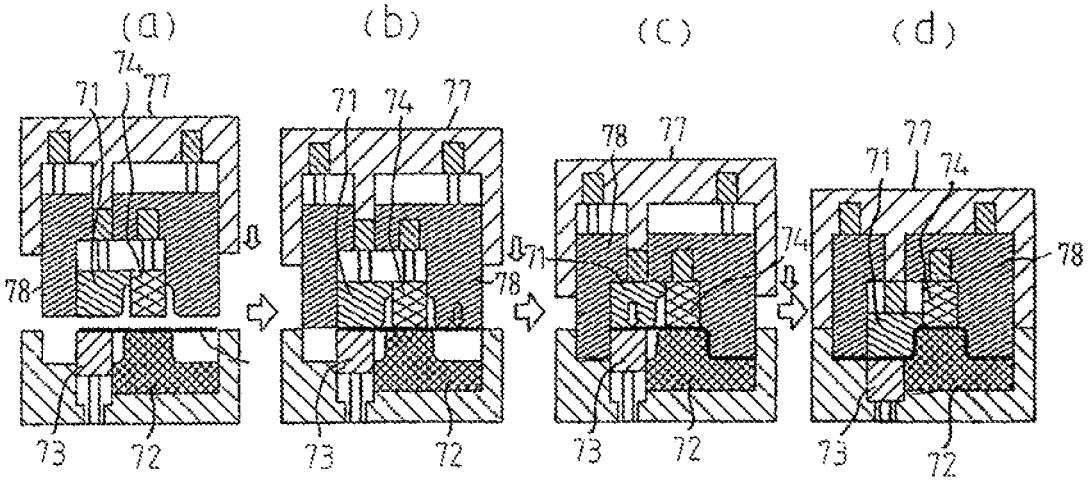
[Fig.7]
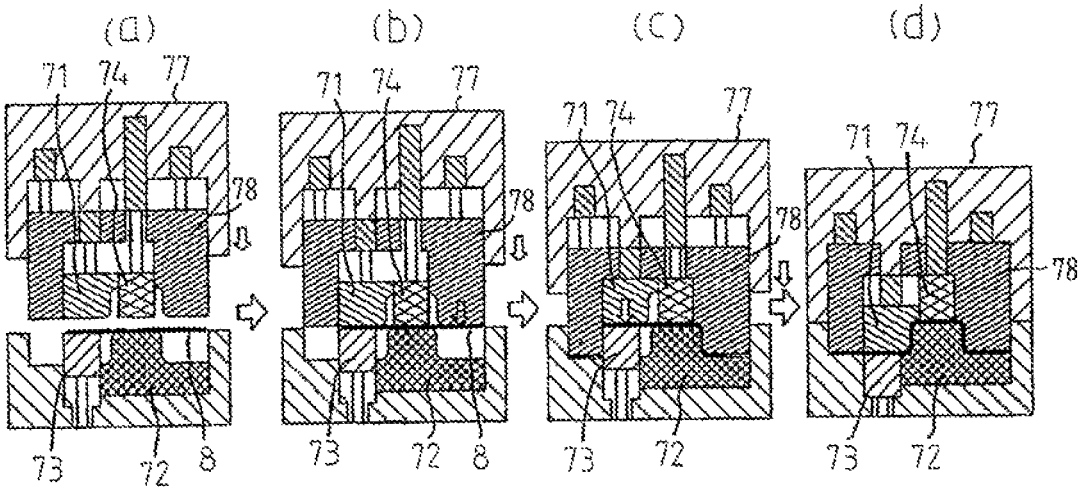

[Fig.8]
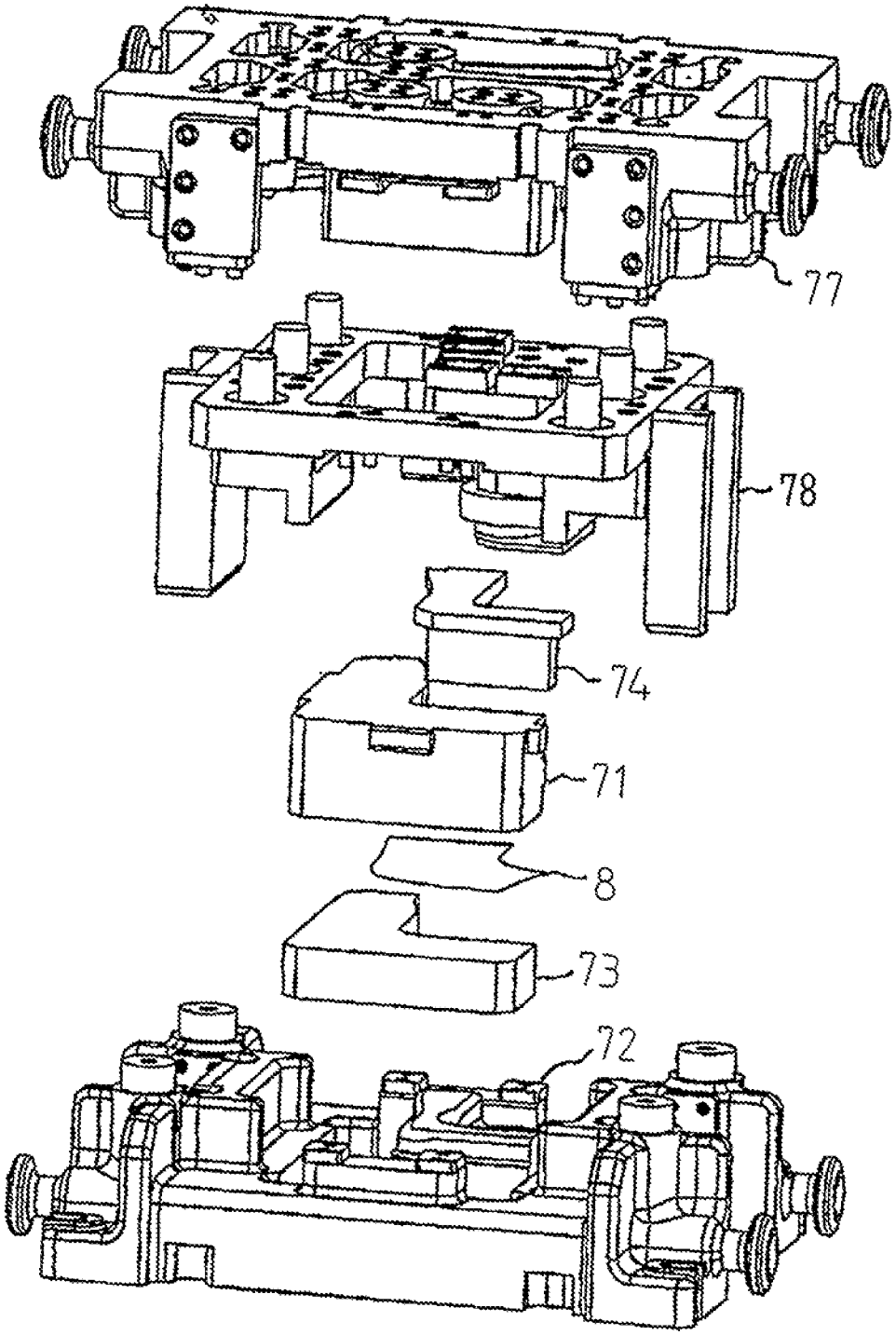

[Fig.9]
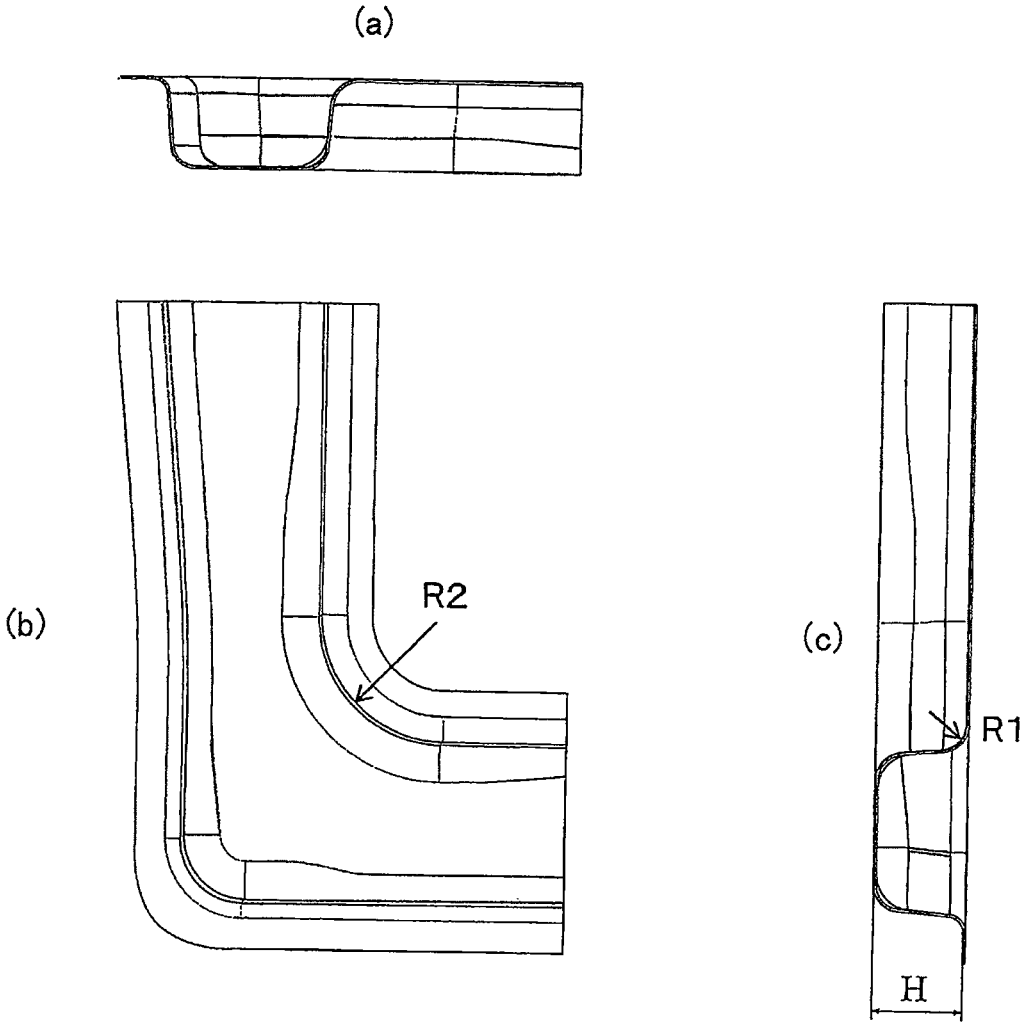

[Fig.10]
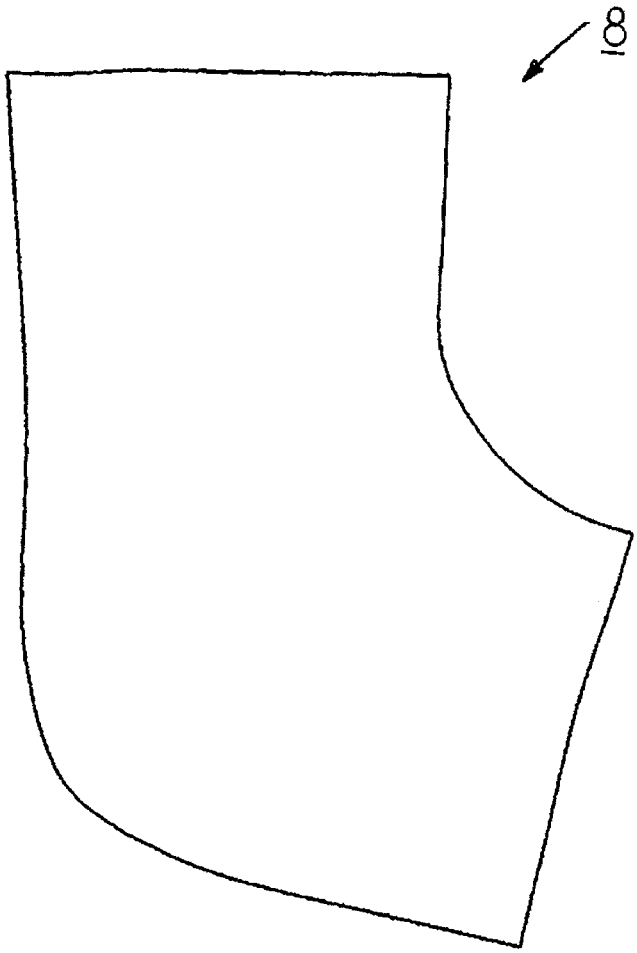

[Fig.11]
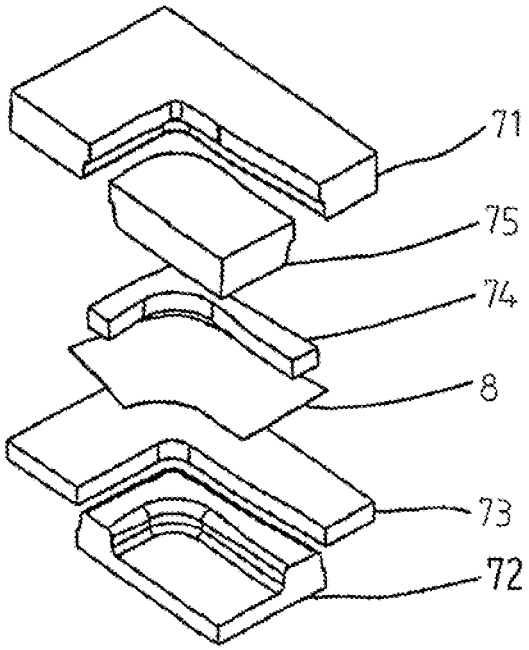

[Fig.12]
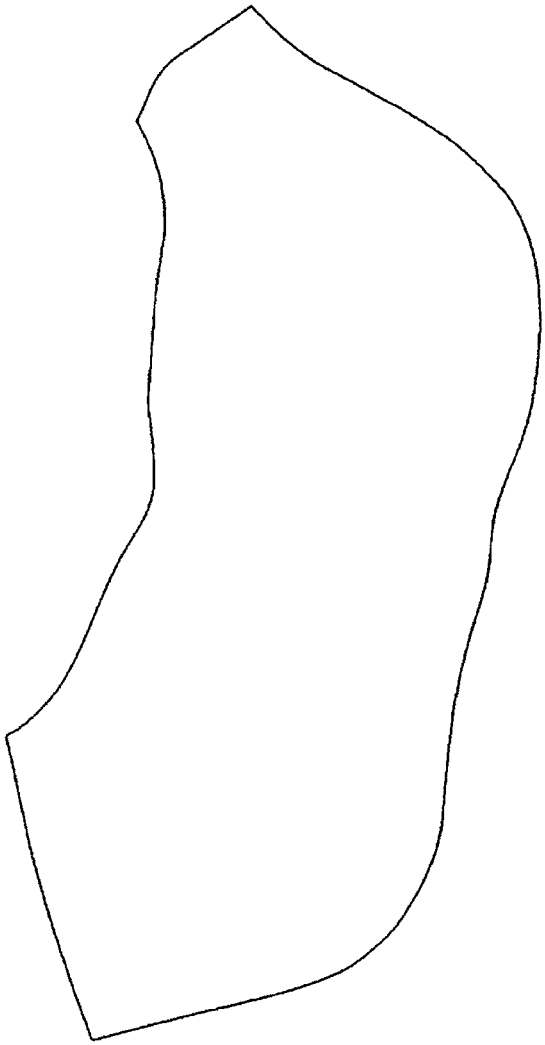

[Fig.13]
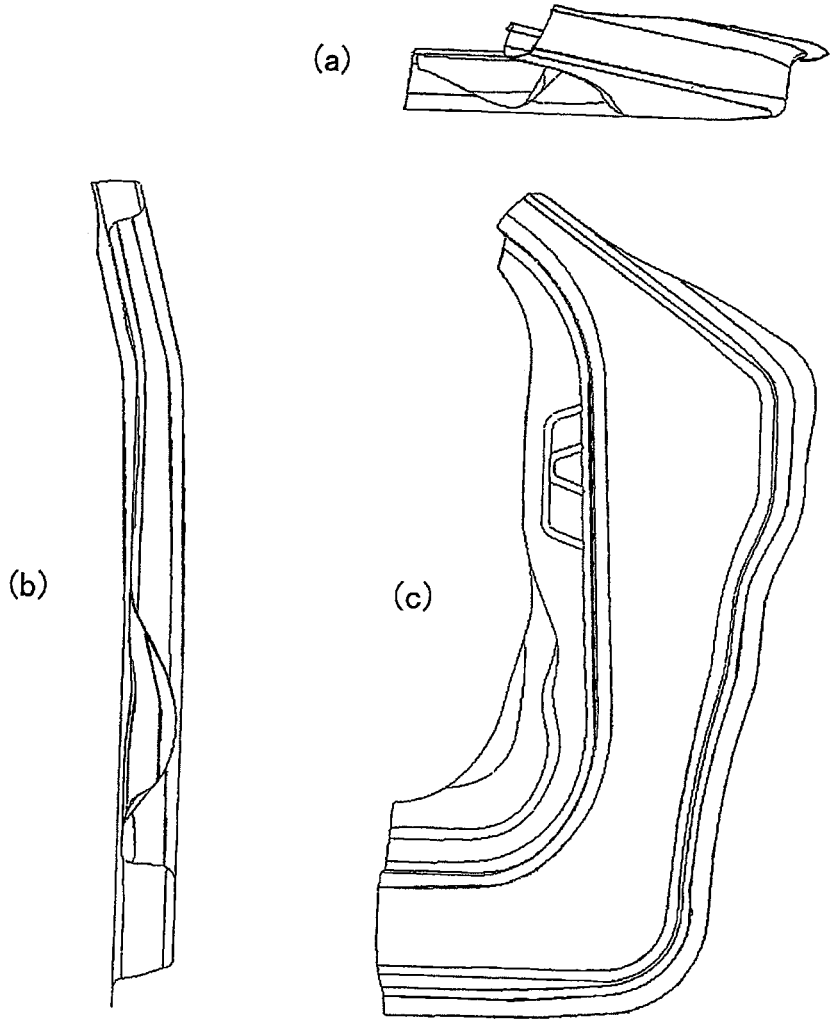

[Fig.14]
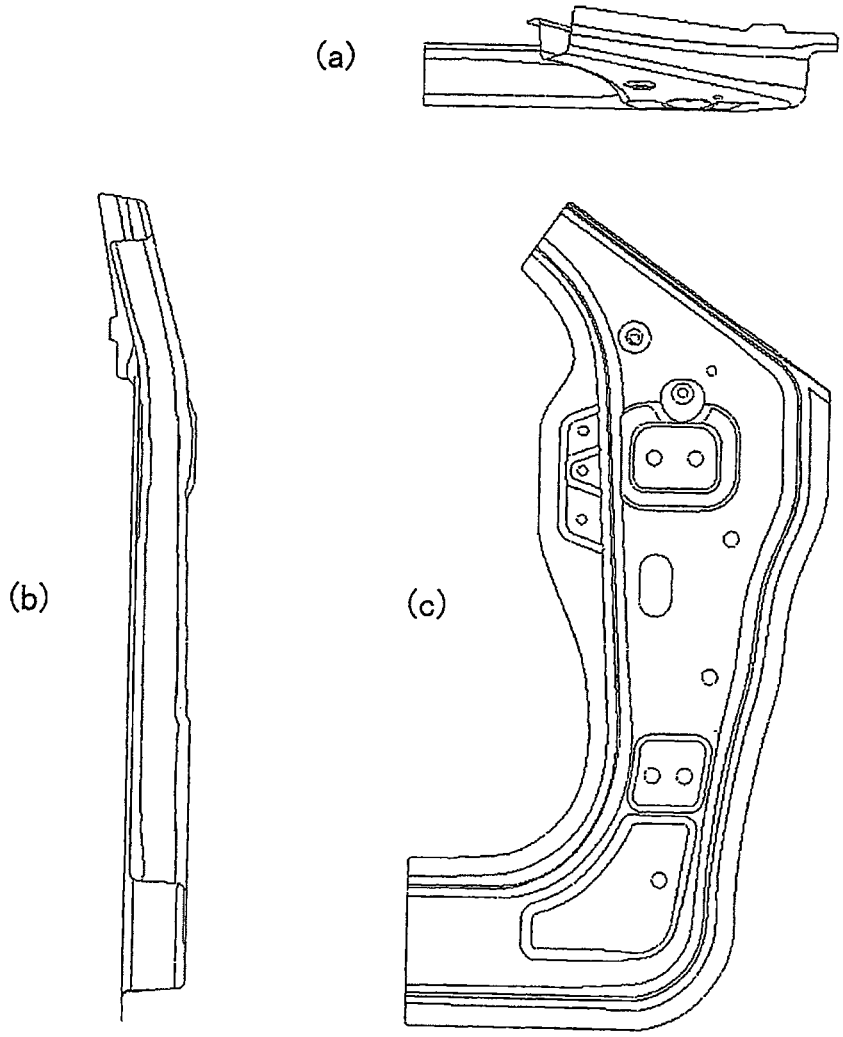

[Fig.15]
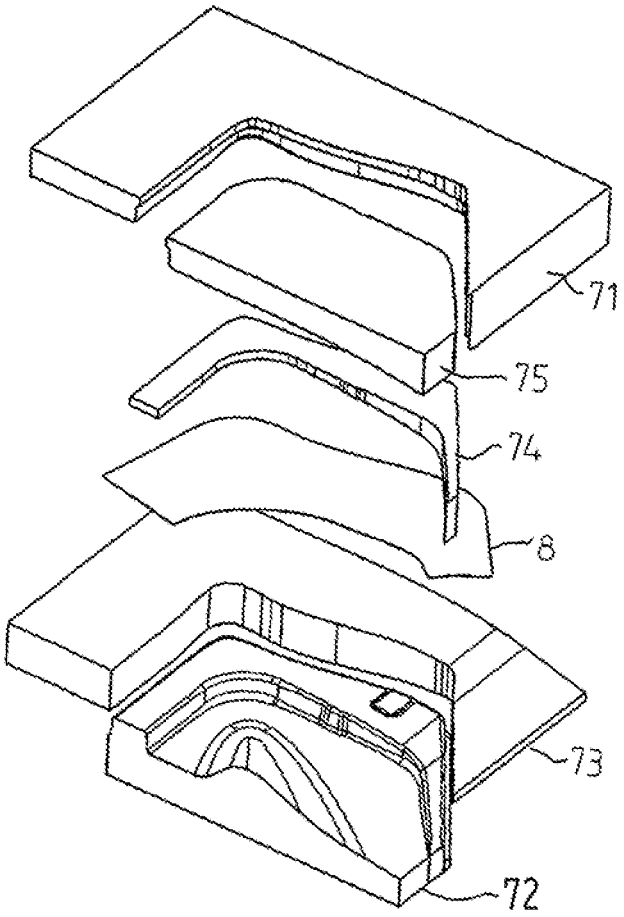

[Fig.16]
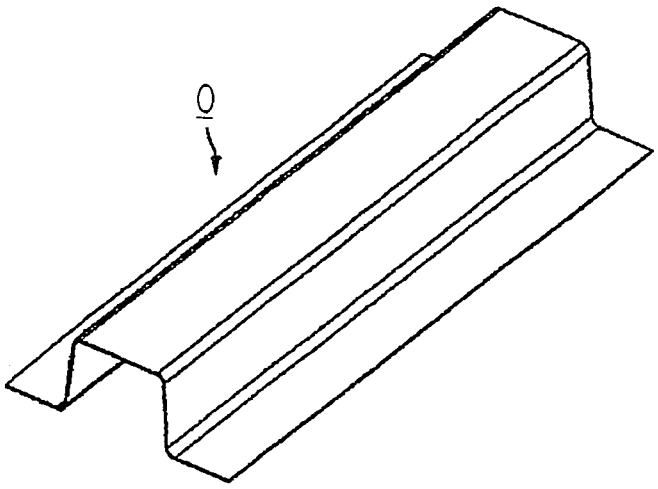
[Fig.17]
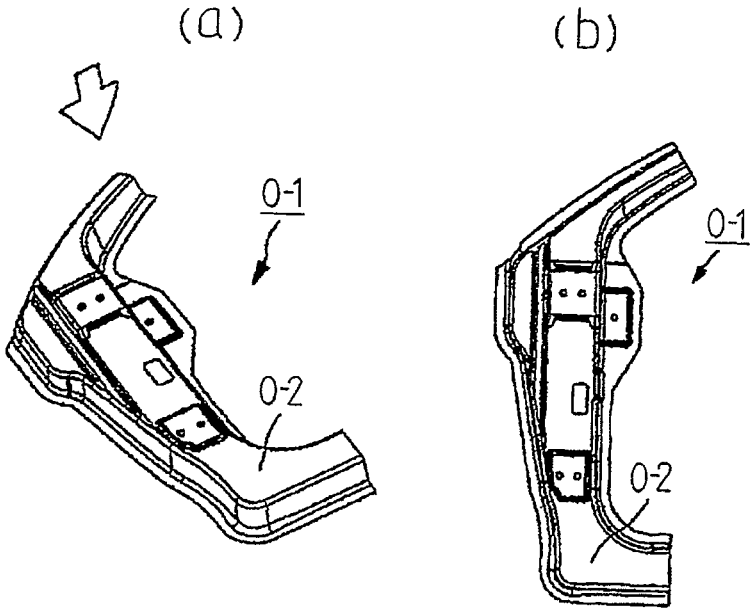

[Fig.18]
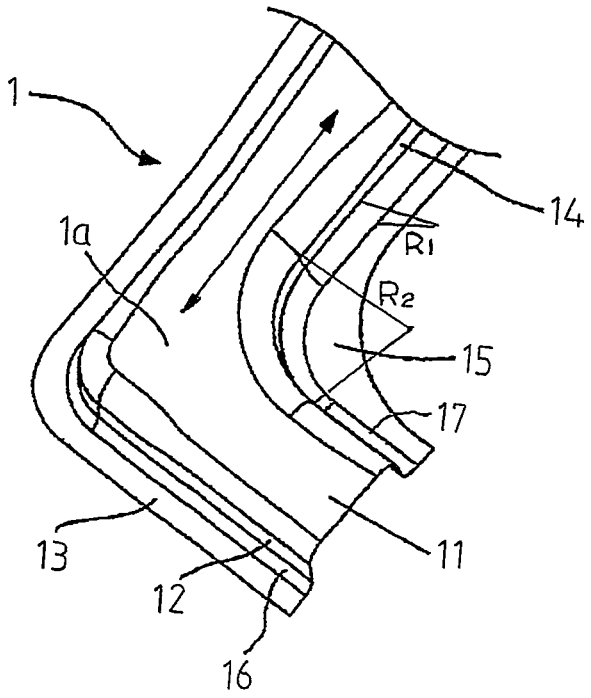
[Fig.19]
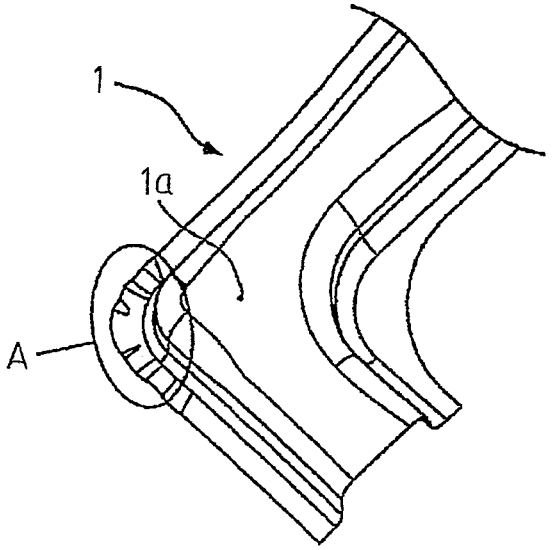

[Fig.20]
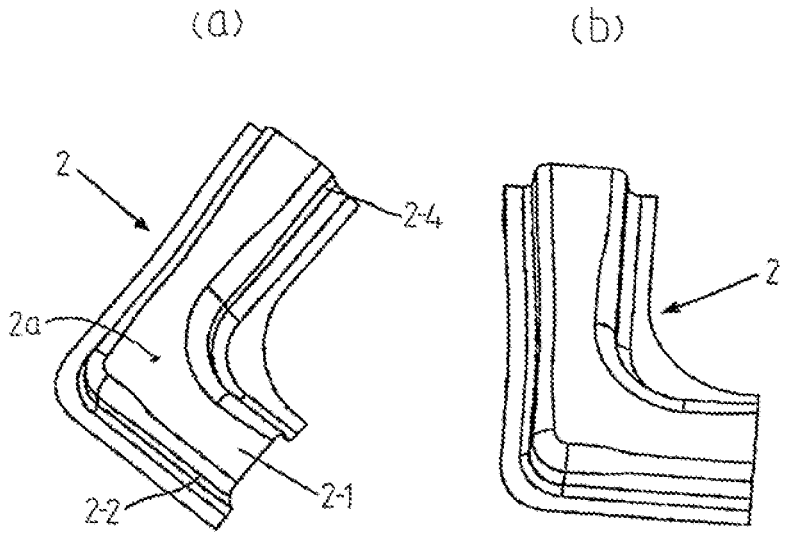
[Fig.21]
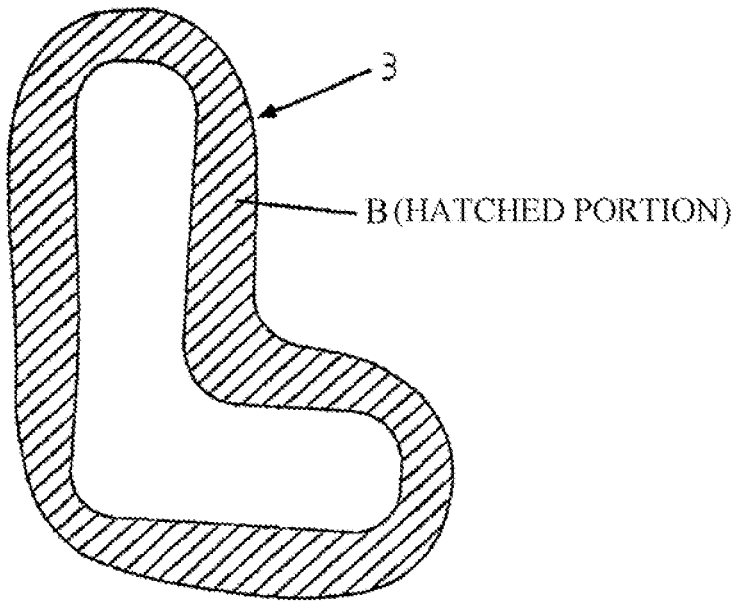

[Fig.22]
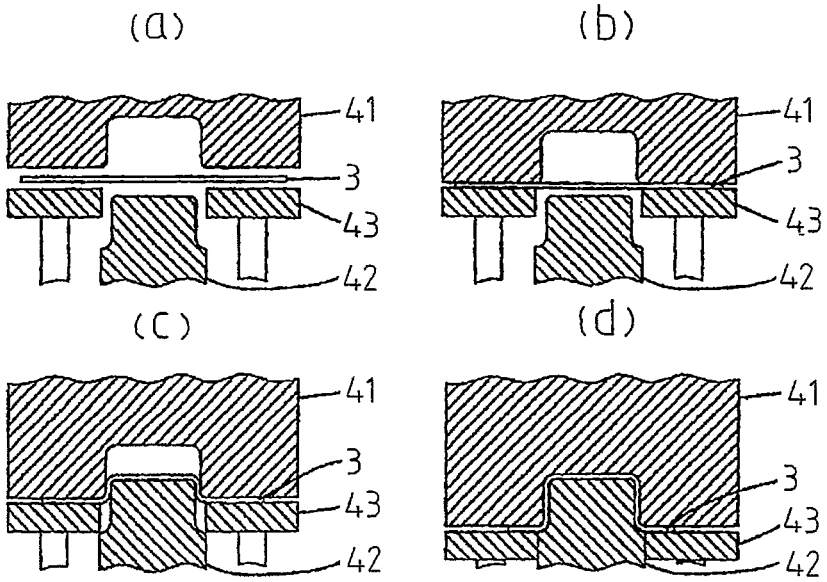
[Fig.23]
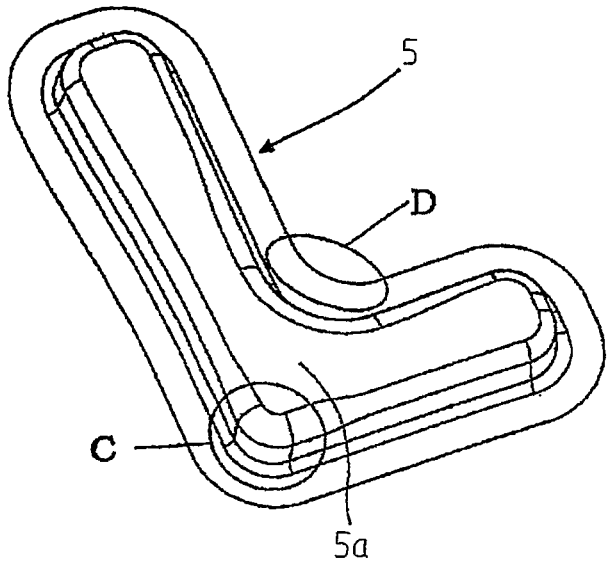

[Fig.24]
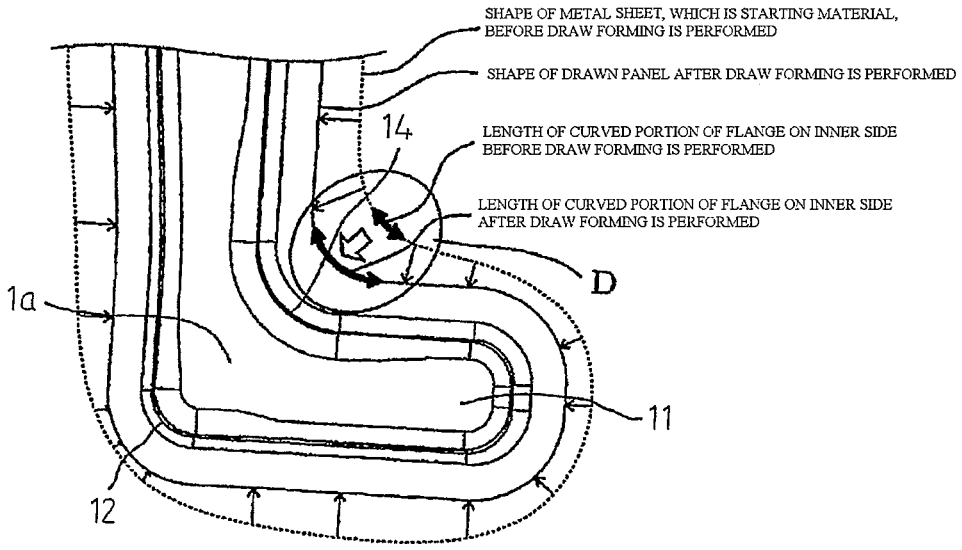

METHOD AND APPARATUS FOR PRODUCING PRESSED COMPONENT

TECHNICAL FIELD

The present invention relates to a method and an apparatus for producing a pressed component. In particular, the present invention relates to a method and an apparatus for producing a pressed component which has a hat-shaped cross section and partially or entirely has an L shape by including a curved portion which curves in a longitudinal direction as viewed in a plan view.

BACKGROUND ART

A vehicle body of an automobile is formed of a plurality of frame members each of which is acquired by performing press forming on a blank (in the description made hereinafter, the description is made by taking the case where the blank is a steel sheet as an example). These frame components are extremely important components for ensuring collision safety of an automobile. For example, a side sill, a cross member, a front pillar or the like is known as a frame member.

The frame member partially or entirely has a hat-shaped cross section in many cases. The hat-shaped cross section is defined by a top plate, two vertical walls, two concave ridges, and two flanges. The two vertical walls are connected to both sides of the top plate. The two concave ridges are respectively connected to the two vertical walls. The two flanges are respectively connected to the two concave ridges. To improve collision safety performance and reduce weight of a vehicle body, increasing strength is required for the frame members.

FIG. 16 is a perspective view showing one example (side sill, for example) of a frame member 0 which has a hat-shaped cross section and has a straight line shape extending in a longitudinal direction as viewed in a plan view and in a side view. FIG. 17 is an explanatory view of a front pillar 0-1 which is one example of the frame member having a hat-shaped cross section, wherein FIG. 17(*a*) is a perspective view, and FIG. 17(*b*) is a plan view. Further, FIG. 18 is a perspective view showing a component (also referred to as "L-shaped pressed component" in this specification) 1 which has a hat-shaped cross section and has an L shape by including a curved portion which curves in a longitudinal direction as viewed in a plan view.

In this specification, "as viewed in a plan view" means to view a frame member from a direction orthogonal to the top plate, which is a portion having the largest planar shape among the member. To be more specific, "as viewed in a plan view" means to view the frame member 0-1 from the direction indicated by an outline arrow in FIG. 17(*a*), and means to view the frame member 0-1 from the direction orthogonal to the paper surface in FIG. 17(*b*).

The frame member 0 exemplified in FIG. 16 has a substantially straight line shape extending in the longitudinal direction. On the other hand, as shown in FIG. 17(*a*) and FIG. 17(*b*), the front pillar 0-1 has an L shape by including a curved portion which curves in a longitudinal direction as viewed in a plan view.

As shown in FIG. 18, the front pillar 0-1 has a hat-shaped cross section at a lower portion 0-2 of the front pillar 0-1 and has a shape which curves into an L shape in a longitudinal direction as viewed in a plan view. To be more specific, the front pillar 0-1 has a hat-shaped cross section defined by a top plate 11, two vertical walls 12, 14 connected to both sides of the top plate 11, two concave ridges 16, 17 respectively connected to the two vertical walls 12, 14, and two flanges 13, 15 respectively connected to the two concave ridges 16, 17. The front pillar 0-1 also includes a curved portion 1*a* curving in a longitudinal direction, thus partially having a shape which curves into an L shape as viewed in a plan view.

The frame member 0 has a substantially straight line shape extending in the longitudinal direction and hence, the frame member 0 can be produced by mainly performing bend forming on a blank. The circumferential length of the cross section of the frame member 0 does not significantly vary in the longitudinal direction. Accordingly, even if a blank is formed of a high strength steel sheet having low ductility, cracks or wrinkles do not easily occur at the time of press working and hence, the frame member 0 can be relatively easily formed.

Patent Document 1 discloses a method for forming by bending a pressed component having a hat-shaped cross section. The method disclosed in Patent Document 1 produces a pressed component which has a hat-shaped cross section, and has a substantially straight line shape extending in the longitudinal direction.

FIG. 19 is a perspective view showing an L-shaped pressed component 1 produced by performing bend forming.

When the L-shaped pressed component 1 shown in FIG. 18 is formed by bending with the method disclosed in Patent Document 1, as shown in FIG. 19, wrinkles occur at a flange portion (portion A) on the outer side of the curved portion 1*a*. For this reason, an L-shaped pressed component 1 is generally formed by performing press working by draw forming. In the draw forming, to control an inflow amount of the blank so as to suppress occurrence of wrinkles, the blank is formed using a blank holder in addition to a die and a punch.

FIG. 20 is an explanatory view showing an L-shaped pressed component 2, wherein FIG. 20(*a*) is a perspective view, and FIG. 20(*b*) is a plan view. FIG. 21 is a plan view showing the shape of a blank 3 and a blank holder holding region B of the blank 3 for performing draw forming FIG. 22(*a*) to FIG. 22(*d*) are cross-sectional views showing the structure of a press tooling for performing draw forming and process of the draw forming. Further, FIG. 23 is a perspective view of a drawn panel 5 formed by performing draw forming.

For example, to form the L-shaped pressed component 2 shown in FIG. 20 by draw forming, as shown in FIG. 22(*a*) to FIG. 22(*d*), a die 41, a punch 42 and a blank holder 43 are used.

First, as shown in FIG. 22(*a*), the blank 3 is disposed between the punch 42 and the blank holder 43 on one side and the die 41 on the other side.

Next, as shown in FIG. 22(*b*), the blank holder holding region B (hatched portion in FIG. 21) on the periphery of the blank 3 is firmly held in a state of being clamped by the blank holder 43 and the die 41. Next, as shown in FIG. 22(*c*), the die 41 is relatively moved in the direction toward the punch 42.

Then, as shown in FIG. 22(*d*), the blank 3 is finally pressed against the punch 42 by the die 41 so as to perform working on the blank 3. The blank 3 is formed into the drawn panel 5 shown in FIG. 23 in this manner.

In performing draw forming, the blank holder holding region B on the periphery of the blank 3 is firmly held in a state of being clamped by the blank holder 43 and the die 41. Accordingly, a region of the blank 3 inside the blank holder holding region B is stretched in a state where tension is applied in performing forming.

Accordingly, the drawn panel 5 can be formed while occurrence of wrinkles is suppressed. An unnecessary portion disposed on the periphery of the drawn panel 5, which is formed, is cut off so as to produce the L-shaped pressed component 2 shown in FIG. 20(*a*) and FIG. 20(*b*).

Performing press working by draw forming allows the formation of a complicated shape which the L-shaped pressed component 2 has. However, as shown in FIG. 21, it is necessary to provide the large blank holder holding region B on the periphery of the blank 3. Accordingly, such a method increases the portion to be removed by cutting as an unnecessary portion after the blank 3 is formed into the drawn panel 5, thus decreasing the material yield rate, and thus increasing production cost.

Further, in a process of forming the drawn panel 5, vertical walls 2-2, 2-4 shown in FIG. 20(*a*) are formed simultaneously. Accordingly, a portion of the blank 3 to be formed into a top plate 2-1 does not significantly flow into the vertical walls 2-2, 2-4 during the forming process. As shown in FIG. 22(*b*) to FIG. 22(*d*), the vertical walls 2-2, 2-4 are formed such that the blank 3 flows in from both sides of the top plate 2-1.

Particularly, a flange (portion "D" in FIG. 23) of the drawn panel 5 on the inner side of a curved portion 5*a*, which curves into an L shape as viewed in a plan view, is brought into a formed state referred to as so-called stretch flange forming. Accordingly, cracks occur when the blank 3 is formed of a high strength steel sheet having low ductility. Particularly, a high strength steel sheet having tensile strength of 590 MPa or more has low ductility and hence, working cannot be performed on the high strength steel sheet without causing occurrence of cracks at the portion "D".

On the other hand, a corner portion (portion "C" in FIG. 23), where the vertical wall 2-2 on the outer side of a curved portion 2*a* and the top plate 2-1 meet in FIG. 20(*a*), has a shape significantly bulging outward. Accordingly, at the corner portion, the blank 3 is significantly stretched, thus causing occurrence of cracks in a high strength steel sheet having low ductility.

The description is made in more detail. FIG. 24 is a plan view for describing an inflow of material in performing draw forming.

In forming the drawn panel 5, a vertical wall 12 on the outer side of the curved portion 1*a* and a vertical wall 14 on the inner side of the curved portion 1*a* are formed simultaneously. Accordingly, a portion of the blank 3 to be formed into the top plate 11 does not flow into the vertical walls 12, 14 so much. As shown in FIG. 24, the vertical walls 12, 14 are formed such that a material flows in from both sides of the top plate 11.

Particularly, a portion (portion "D" in FIGS. 23, 24) of the blank 3 to be formed on the inner side of the curved portion 1*a* moves from the inner side to the outer side of the curved portion 1*a*, thus being significantly stretched in the radial direction of the curved portion 1*a*. Such a state is a formed state referred to as "stretch flange forming". Accordingly, cracks occur in a high strength steel sheet having low ductility.

On the other hand, the portion "C" shown in FIG. 23 is a corner portion on the outer side of the curved portion 1*a*, and has a shape significantly bulging outward. Accordingly, the blank 3 is significantly stretched at the portion "C". Due to such stretch, also at the portion "C", in the same manner as the portion "D", cracks occur in a high strength steel sheet having low ductility.

Due to the above-mentioned reasons, conventionally, the blank 3 formed of a high strength steel sheet having low ductility, particularly, a high strength steel sheet having tensile strength of 590 MPa or more cannot be used as a starting material for the L-shaped pressed component 2 and hence, a steel sheet having excellent ductility but having relatively low strength has been used for the blank 3. Therefore, increasing the sheet thickness of the blank 3 cannot be avoided for ensuring predetermined strength, thus going against a demand to reduce the weight of vehicle bodies.

Patent Document 2 discloses a method of producing an L-shaped pressed component where an extra thickness portion protruding in a sheet thickness direction is formed at a portion of a blank to be formed on the inner side of the L-shaped curved portion and, thereafter, press forming is performed on the blank, on which the extra thickness portion is formed, so as to compress the extra thickness portion, thus producing an L-shaped pressed component.

The method disclosed in Patent Document 2 requires to compress, by performing press forming, the extra thickness portion of the blank which protrudes in the sheet thickness direction. Accordingly, when a blank is formed of a steel sheet having excellent ductility but having relatively low strength, forming can be performed on the blank without causing occurrence of cracks. However, when a blank is formed of a high strength steel sheet having low ductility, particularly, a high strength steel sheet having tensile strength of 590 MPa or more, cracks inevitably occur at the time of performing press forming.

In Patent Document 3, inventors of the present invention have disclosed the invention where an L-shaped pressed component can be produced with high yield rate without causing occurrence of wrinkles or cracks even if press forming is performed on the blank 3 formed of a high strength steel sheet having tensile strength of 590 MPa or more. This invention produces an L-shaped pressed component 1 through following first to third steps as shown in FIG. 1(*a*) to FIG. 1(*e*) described later.

First step: after a blank 8 is disposed between a punch 72 and a blank holder 73 on one side and a pad 74, a die 71 and a bending die 75 on the other side, a portion of the blank 8 to be formed into the top plate 11 is held in a state of being clamped by the pad 74 and the punch 72 and a portion of the blank 8 to be formed into a portion disposed further outward of the curved portion 1*a* than the portion of the blank 8 to be formed into the top plate 11 is held in a state of being clamped by the blank holder 73 and the die 71 (see FIG. 1(*a*) and FIG. 1(*b*)).

Second step: after the first step, the bending die 75 is relatively moved in a direction toward a side where the punch 72 is disposed so as to perform working on the blank 8, thus forming the vertical wall 14, a concave ridge 17 and a flange 15 on the inner side of the curved portion 1*a* (see FIG. 1(*c*)).

Third step: after the second step, with the blank 8 held in a state of being clamped by the blank holder 73 and the die 71, the die 71 and the blank holder 73 are moved relative to the blank 8 in a direction toward a side where the blank holder 73 is disposed so as to perform working on the blank 8, thus forming the vertical wall 12, the concave ridge 16 and a flange 13 on the outer side of the curved portion 1*a*

(see FIG. 1(*d*)). Then, the pad 74, the die 71 and the bending die 75 are elevated so as to take out the formed pressed component 1 (see FIG. 1(*e*)).

In the second step, although the vertical wall 14, the concave ridge 17 and the flange 15 on the inner side of the curved portion 1*a* are formed, the vertical wall 12, the concave ridge 16 and the flange 13 on the outer side of the curved portion 1*a* are not formed. Accordingly, the blank 8 during forming is pulled only from the inner side of the curved portion 1*a* so that a portion of the blank 8 to be formed into the top plate 11 flows into the inner side of the curved portion 1*a*.

Accordingly, in the second step, unlike the draw forming shown in FIG. 22, a portion of the blank 8 to be formed on the inner side of the curved portion 1*a* does not significantly move from the inner side to the outer side of the curved portion 1*a* during the forming process.

Further, a distal end of the blank 8 in the longitudinal direction flows into the inner side of the curved portion 1*a* so as to bend the entire blank 8 and hence, the flange 15 on the inner side of the curved portion 1*a* is brought into a compressed state. Accordingly, an amount of stretch of the flange 15 on the inner side of the curved portion 1*a* at the time of performing forming is remarkably reduced compared to draw forming.

Further, during the forming process for the vertical wall 14, the concave ridge 17 and the flange 15 on the inner side of the curved portion 1*a*, a portion to be formed into the top plate 11 and a portion to be formed into the flange 13 also flow into the inner side of the curved portion 1*a*, thus bringing about a state where the blank 8 contracts in the longitudinal direction, and a compressive stress remains.

Accordingly, a corner portion forming a meeting portion between the vertical wall 12 on the outer side of the curved portion 1*a* and the top plate 11 is also formed from a state where a compressive stress remains. Therefore, compared to draw forming where forming is performed from a state having no compressive stress, required ductility of the blank is reduced.

Accordingly, an amount of stretch of the blank 8 can be suppressed to a small amount at portions of a metal sheet having high strength (for example, a high tensile strength steel sheet having tensile strength of 590 MPa or more) where cracks occur when draw forming is performed, that is, at the flange 15 on the inner side of the curved portion 1*a*, and at a corner portion forming a meeting portion between the vertical wall 12 on the outer side of the curved portion 1*a* and the top plate 11. Therefore, even if a metal sheet having low ductility and high strength is used for the blank 8, forming can be performed on the blank 8 without causing occurrence of cracks.

Further, the vertical wall 14, the concave ridge 17 and the flange 15 on the inner side of the curved portion 1*a* are formed by bending with the bending die 75 and the punch 72. Accordingly, it is unnecessary to provide a blank holder holding region, which is necessarily provided in the case of draw forming, to a portion to be formed on the inner side of the curved portion 1*a* or to a portion to be formed into a distal end portion in the longitudinal direction. The blank 8 can be reduced in size by a corresponding amount and hence, the material yield rate can be also increased.

LIST OF PRIOR ART DOCUMENTS

Patent Document

Patent Document 1: JP2006-015404A
Patent Document 2: JP64-66024A
Patent Document 3: WO 2014/106932

SUMMARY OF INVENTION

Technical Problem

Inventors of the present invention have made extensive studies in order to further improve formability of an L-shaped pressed component. As a result, it was found that even if press working is performed on the blank 8 by bend forming according to the second step disclosed in Patent Document 3, an L-shaped pressed component 1 may not be produced without causing forming defects in some cases.

Such a case may be, for example:

(a) the case where the blank 8 is formed of an ultrahigh tensile strength steel sheet having tensile strength of 1180 MPa or more, (b) the case where the height of the L-shaped pressed component 1 (a projection distance of the vertical wall 12, 14 in a height direction of a product) is high, that is, 70 mm or more, (c) the case where the radius of curvature $R_1$ of the concave ridge 16, 17 of the L-shaped pressed component 1 is small, that is, 10 mm or less, or (d) the case where the radius of curvature $R_2$ of the curved portion 1*a* of the L-shaped pressed component 1 as viewed in a plan view is small, that is, 100 mm or less. In any of these cases, cracks occur in the flange 15 on the inner side of the curved portion 1*a* in the second step disclosed in Patent Document 3.

Further, (e) also in the case where at least two of the followings are satisfied: that the blank 8 is formed of an ultrahigh tensile strength steel sheet having tensile strength of 1180 MPa or more; that the height of the L-shaped pressed component 1 is 55 mm or more; that a radius of curvature $R_1$ of the concave ridge 16, 17 of the L-shaped pressed component 1 is 15 mm or less; or that a radius of curvature $R_2$ of the curved portion 1*a* of the L-shaped pressed component 1 on the inner side is 140 mm or less, cracks occur in the flange 15 on the inner side of the curved portion 1*a* in the second step disclosed in Patent Document 3.

The present invention has been made to improve the forming limit of the invention disclosed in Patent Document 3 so as to solve a new problem in the second step disclosed in Patent Document 3. It is an objective of the present invention to provide a method and an apparatus for producing an L-shaped pressed component 1 without causing occurrence of cracks in the flange 15 on the inner side of the curved portion 1*a* even if press working according to the second step is performed in any one of the above-mentioned cases (a) to (e).

Solution to Problem

The inventors of the present invention have made extensive studies in order to solve the above-mentioned problem and, as a result, the following findings A to D were acquired. The inventors of the present invention have made further studies, and completed the present invention.

(A) In performing forming according to the second step where the vertical wall 14 on the inner side of the curved portion 1*a* is formed, a portion of the blank 8 to be formed into an end portion of the top plate 11 in an extending direction (portion positioned on the lower side of the L shape) flows into a portion to be formed into the vertical wall 14 on the inner side of the curved portion 1*a*. With such flowing, the blank 8 is supplied to the portion to be formed into the flange 15 on the inner side of the curved portion 1*a*.

Accordingly, by increasing an inflow amount of the portion of the blank 8 to be formed into the end portion of the top plate 11 in the extending direction to the portion of the blank 8 to be formed into the vertical wall 14 on the inner side of the curved portion 1*a*, cracks in the flange 15 on the inner side of the curved portion 1*a* can be suppressed, thus improving forming limit in the second step.

(B) In performing press working, a limit amount of the blank 8 which can flow into a portion to be formed into the vertical wall 14 on the inner side of the curved portion 1*a* is geometrically determined by variation in cross-sectional peripheral length of the flange 15 on a cross section in a flow direction of the blank 8 between before and after the forming is performed. This limit amount forms a forming limit in the second step where the vertical wall 14 on the inner side of the curved portion 1*a* is formed.

(C) A material inflow promoting portion, such as a bead, for example, is formed simultaneously in performing second working in a side by side manner with respect to a portion of the blank 8 to be formed into the flange 15 on the inner side of the curved portion 1*a* of the L-shaped pressed component 1 (desirably in a region of the blank 8 outside a region of the blank 8 to be formed into the pressed component 1). With such a configuration, it is possible to increase an amount of a portion (a portion positioned on the lower side of the L shape) of the blank 8 to be formed into the end portion of the top plate 11 in the extending direction to be flowing into a portion of the blank 8 to be formed into the flange 15 on the inner side of the curved portion 1*a*.

(D) The shape of the material inflow promoting portion is set to a shape which can ensure a difference in line length in a direction of material inflow (the direction of maximum principal strain of deformation of the flange 15 on the inner side of the curved portion 1*a* of the pressed component 1) so that an inflow amount of material can be increased, thus improving forming limit in the second step.

The present invention is as described below.

(1) A method for producing a pressed component which has a hat-shaped cross section and partially or entirely has an L shape as viewed in a plan view by including a curved portion which curves in a longitudinal direction as viewed in a plan view from a direction orthogonal to a top plate, the pressed component being formed by performing press working on a blank disposed between a punch and a blank holder on one side and a pad, a die and a bending die on another side, the hat-shaped cross section being defined by the top plate extending in the longitudinal direction, two vertical walls connected to both sides of the top plate, two concave ridges respectively connected to the two vertical walls, and two flanges respectively connected to the two concave ridges, wherein the method satisfies following conditions 1 and 2, and the press working includes following first to third steps:

the first step of holding a portion of the blank to be formed into the top plate in a state of being clamped by the pad and the punch, and holding a portion of the blank to be formed into a portion disposed further outward of the curved portion than the portion of the blank to be formed into the top plate in a state of being clamped by the blank holder and the die, the second step of relatively moving, after the first step, the bending die in a direction toward a side where the punch is disposed so as to perform press working on the blank by bend forming, thus forming the vertical wall on an inner side of the curved portion, the concave ridge connected to the vertical wall, and the flange connected to the concave ridge, the third step of relatively moving, after the second step, the die and the blank holder in a direction toward a side where the punch is disposed with the blank held in a state of being clamped by the blank holder and the die so as to perform press working on the blank by draw forming, thus forming the vertical wall on the outer side of the curved portion, the concave ridge connected to the vertical wall, and the flange connected to the concave ridge.

[Condition 1]

One or more material inflow promoting portion is formed in the second step in a side by side manner with respect to a portion of the blank to be formed into the flange on the inner side of the curved portion of the pressed component. The material inflow promoting portion increases an amount of the blank flowing into a portion to be formed into the flange on the inner side of the curved portion.

[Condition 2]

The material inflow promoting portion has cross sectional shapes where cross-sectional peripheral lengths on cross sections, which extend parallel to a straight line being in contact with a center position on the inner side of the curved portion as viewed in a plan view from a direction orthogonal to the top plate, and which extend along a direction orthogonal to the top plate, increase as a distance from the flange on the inner side of the curved portion of the pressed component increases.

(2) The method for producing a pressed component according to 1, wherein a following condition 3 or 4 is satisfied.

[Condition 3]

At least one of followings is satisfied: that the blank is formed of an ultrahigh tensile strength steel sheet having tensile strength of 1180 MPa or more; that a projection distance of the vertical wall in a height direction of a product, which is a height of the pressed component, is 70 mm or more; that a radius of curvature of the concave ridge of the pressed component is 10 mm or less as viewed in a side view; or that a radius of curvature of the curved portion of the pressed component on the inner side is 100 mm or less as viewed in a plan view.

[Condition 4]

At least two or more of followings are satisfied: that the blank is formed of an ultrahigh tensile strength steel sheet having tensile strength of 1180 MPa or more; that a projection distance of the vertical wall in a height direction of a product, which is a height of the pressed component, is 55 mm or more; that a radius of curvature of the concave ridge of the pressed component is 15 mm or less as viewed in a side view; or that a radius of curvature of the curved portion of the pressed component on the inner side is 140 mm or less as viewed in a plan view.

(3) The method for producing a pressed component according to 1 or 2, wherein the material inflow promoting portion is formed on the blank in a region outside a region to be formed into the pressed component.

(4) The method for producing a pressed component according to any one of 1 to 3, wherein the cross-sectional peripheral lengths of the material inflow promoting portion are partially constant.

(5) The method for producing a pressed component according to any one of 1 to 4, wherein the material inflow promoting portion is formed of a projecting bead or a concave bead, the projecting bead projecting in a direction from the flange toward the top plate in a direction along which the flange and the top plate are arranged, the concave bead projecting in a direction from the top plate toward the flange in a direction along which the flange and the top plate are arranged.

(6) The method for producing a pressed component according to any one of 1 to 5, wherein the cross-sectional peripheral lengths of the material inflow promoting portion increase in a stepwise manner.

(7) The method for producing a pressed component according to any one of 1 to 6, wherein on a vertical cross section including a straight line orthogonal to, in a horizontal plane, a straight line which is in contact with a center position on the inner side of the curved portion in a state where the second step is finished, the material inflow promoting portion has an external shape obtained by connecting a part of the blank to be formed into a meeting point between the concave ridge and the flange on the inner side of the curved portion and an edge portion of the blank.

(8) The method for producing a pressed component according to any one of 1 to 7 including a following fourth step after the third step, the fourth step where an unnecessary portion is removed which remains at a part of a periphery of a formed product acquired in the third step, and which includes an entire or a part of the material inflow promoting portion.

In the method for producing a pressed component according to the present invention, it is desirable that the punch have a shape including respective shapes on the back surface side in the sheet thickness direction of the top plate, the vertical wall positioned on the inner side of the curved portion, the concave ridge connected to this vertical wall, and the flange connected to this concave ridge, the blank holder have a shape including shapes on the back surface side in the sheet thickness direction of the concave ridge connected to the vertical wall positioned on the outer side of the curved portion, and the flange connected to this concave ridge, the pad have a shape including a shape on the front surface side in the sheet thickness direction of the top plate so as to oppose the blank holder, the die have a shape including respective shapes on the front surface side in the sheet thickness direction of the vertical wall positioned on the outer side of the curved portion, the concave ridge connected to this vertical wall, and the flange connected to this concave ridge, and the bending die have a shape including respective shapes on the front surface side in the sheet thickness direction of the vertical wall positioned on the inner side of the curved portion, the concave ridge connected to this vertical wall, and the flange connected to this concave ridge.

In the method for producing a pressed component according to the present invention, a blank may be a pre-formed metal sheet.

In the method for producing a pressed component according to the present invention, after the pressed component is subjected to the third step, the blank holder is fixed to the punch such that the relative movement is prevented so as to prevent the blank holder from pressurizing by pressing the formed pressed component against the die and, in such a state, the pad, the die and the bending die are separated from the blank holder and the punch so as to take out the pressed component from the inside of the press tooling.

In the method for producing a pressed component according to the present invention, it is desirable that the blank have a sheet thickness of 0.8 mm or more and 3.2 mm or less.

In the method for producing a pressed component according to the present invention, it is desirable that, as viewed in a plan view, the width of the top plate be 30 mm or more and 400 mm or less, the projection distance of the vertical wall in a height direction of a product, which is the height of a pressed component, be 300 mm or less and a radius of curvature of the curved portion of the pressed component on the inner side be 5 mm or more as viewed in a plan view.

(9) An apparatus for producing a pressed component, the apparatus including a punch and a blank holder, and a pad, a die and a bending die which are disposed so as to oppose the punch and the blank holder, the apparatus producing a pressed component which has a hat-shaped cross section and partially or entirely has an L shape as viewed in a plan view by including a curved portion which curves in a longitudinal direction as viewed in a plan view from a direction orthogonal to a top plate, the pressed component being formed by performing press working on a blank, the hat-shaped cross section being defined by the top plate extending in the longitudinal direction, two vertical walls connected to both sides of the top plate, two concave ridges respectively connected to the two vertical walls, and two flanges respectively connected to the two concave ridges, wherein the apparatus satisfies following conditions 1 and 2, and the press working includes following first to third steps:

the first step where the pad clamps and holds, in cooperation with the punch, a portion of the blank to be formed into the top plate, and the blank holder clamps and holds, in cooperation with the die, a portion of the blank to be formed into a portion disposed further outward of the curved portion than the portion of the blank to be formed into the top plate, the second step where, after the first step, the bending die is relatively moved in a direction toward a side where the punch is disposed so as to perform working on the blank, thus forming the vertical wall on an inner side of the curved portion, the concave ridge connected to the vertical wall, and the flange connected to the concave ridge, the third step where, after the second step, with the blank holder clamping and holding the blank in cooperation with the die, the die and the blank holder are moved relative to the blank holder in a direction toward a side where the blank holder is disposed so as to perform working on the blank, thus forming the vertical wall on the outer side of the curved portion, the concave ridge connected to the vertical wall, and the flange connected to the concave ridge so as to form the pressed component.

[Condition 1]

The bending die and the punch includes a material-inflow-promoting-portion forming mechanism configured to form, in the second step, one or more material inflow promoting portion in a side by side manner with respect to a portion of the blank to be formed into the flange on the inner side of the curved portion of the pressed component. The material inflow promoting portion increases an amount of the blank flowing into a portion to be formed into the flange on the inner side of the curved portion.

[Condition 2]

The material-inflow-promoting-portion forming mechanism forms the material inflow promoting portion such that cross-sectional peripheral lengths on cross sections, which extend parallel to a straight line being in contact with a center position of an inner circumference of the curved portion as viewed in a plan view from a direction orthogonal to the top plate, and which extend along a direction orthogonal to the top plate, increase as a distance from the flange on the inner side of the curved portion of the pressed component increases.

(10) The apparatus for producing a pressed component according to 9, wherein a following condition 3 or 4 is further satisfied.

[Condition 3]

At least one of followings is satisfied: that the blank is formed of an ultrahigh tensile strength steel sheet having tensile strength of 1180 MPa or more; that a projection distance of the vertical wall in a height direction of a product, which is a height of the pressed component, is 70 mm or more; that a radius of curvature of the concave ridge of the pressed component is 10 mm or less as viewed in a side view; or that a radius of curvature of the curved portion of the pressed component on the inner side is 100 mm or less as viewed in a plan view.

[Condition 4]

At least two or more of followings are satisfied: that the blank is formed of an ultrahigh tensile strength steel sheet having tensile strength of 1180 MPa or more; that a projection distance of the vertical wall in a height direction of a product, which is a height of the pressed component, is 55 mm or more; that a radius of curvature of the concave ridge of the pressed component is 15 mm or less as viewed in a side view; or that a radius of curvature of the curved portion of the pressed component on the inner side is 140 mm or less as viewed in a plan view.

(11) The apparatus for producing a pressed component according to 9 or 10, wherein the material-inflow-promoting-portion forming mechanism forms the material inflow promoting portion on the blank in a region outside a region to be formed into the pressed component.

(12) The apparatus for producing a pressed component according to any one of 9 to 11, wherein the cross-sectional peripheral lengths of the material inflow promoting portion are partially constant.

(13) The apparatus for producing a pressed component according to any one of 9 to 12, wherein the material inflow promoting portion is formed of a projecting bead or a concave bead, the projecting bead projecting in a direction from the flange toward the top plate in a direction along which the flange and the top plate are arranged, the concave bead projecting in a direction from the top plate toward the flange in a direction along which the flange and the top plate are arranged.

(14) The apparatus for producing a pressed component according to any one of 9 to 13, wherein the material-inflow-promoting-portion forming mechanism is provided in a region which allows at least the blank to come into contact with the material-inflow-promoting-portion forming mechanism in a state where the first step is finished.

(15) The apparatus for producing a pressed component according to any one of 9 to 14, wherein the material-inflow-promoting-portion forming mechanism forms the material inflow promoting portion such that the cross-sectional peripheral lengths increase in a stepwise manner.

(16) The apparatus for producing a pressed component according to any one of 9 to 15, wherein the material-inflow-promoting-portion forming mechanism forms the material inflow promoting portion such that, on a vertical cross section including a straight line orthogonal to, in a horizontal plane, a straight line which is in contact with a center position on the inner side of the curved portion in a state where the second step is finished, the material inflow promoting portion has an external shape obtained by connecting a part of the blank to be formed into a meeting point between the concave ridge and the flange on the inner side of the curved portion and an edge portion of the blank.

(17) The apparatus for producing a pressed component according to any one of 9 to 16, the apparatus including a device configured to perform a following fourth step after the third step, the fourth step where an unnecessary portion is removed which remains at a part of a periphery of a formed product acquired in the third step, and which includes an entire or a part of the material inflow promoting portion.

It is desirable that the apparatus for producing a pressed component according to the present invention include a locking mechanism configured to fix the blank holder to the punch so as to prevent the relative movement at the time of releasing the press tooling after completion of forming.

It is desirable that the apparatus for producing a pressed component according to the present invention include: a sub-base which elevatably supports the pad and the die and is formed as an integral body with the bending die; and a die base which supports the sub-base such that the sub-base can freely enter and withdraw from the die base.

It is desirable that the apparatus for producing a pressed component according to the present invention include: a sub-base which elevatably supports the die and is formed as an integral body with the bending die; and a die base which elevatably supports the pad and supports the sub-base such that the sub-base can freely enter and withdraw from the die base.

Advantageous Effects of Invention

Even if second working disclosed in Patent Document 3 is performed by the present invention in a state where the condition 3 or 4 is satisfied, the present invention can increase an inflow amount of material more than the invention disclosed in Patent Document 3, thus improving forming limit. Accordingly, the present invention can produce an L-shaped pressed component with high yield rate without causing occurrence of cracks in a flange on the inner side of the curved portion.

BRIEF DESCRIPTION OF DRAWINGS

FIG. 1(*a*) to FIG. 1(*e*) are cross-sectional views schematically showing the configuration of a producing apparatus and forming steps according to an embodiment of the present invention.

FIG. 2(*a*) to FIG. 2(*e*) are cross-sectional views showing an example of the configuration of another press tooling and forming steps according to the embodiment of the present invention.

FIG. 2A is an explanatory view partially showing an example of the configuration of the producing apparatus according to the embodiment of the present invention.

FIG. 2B is an explanatory view partially showing one example of a second step of forming a vertical wall on the inner side of a curved portion of an intermediate formed product formed by performing press forming with the producing apparatus according to the embodiment of the present invention.

FIG. 2C is an explanatory view showing the positional relationship between a material-inflow-promoting-portion forming mechanism and a concave ridge forming portion of the producing apparatus according to the embodiment of the present invention and a blank.

FIG. 2D is an explanatory view showing a cross section of a conventional punch, provided with no material-inflow-promoting-portion forming mechanism, which corresponds to a cross section A-A in FIG. 2A.

FIG. 2E is an explanatory view showing the positional relationship between the material-inflow-promoting-portion forming mechanism and the concave ridge forming portion of the producing apparatus according to the embodiment of the present invention and the blank, and showing positions of cross sections B, C, D.

FIG. 2F is a graph showing a difference in cross-sectional peripheral length on the cross sections B, C, D of a flange forming portion of a punch with respect to a conventional punch.

FIG. 2G is an explanatory view showing the cross section A-A of the punch provided with the material-inflow-promoting-portion forming mechanism.

FIG. 2H is an explanatory view showing the positional relationship between the material-inflow-promoting-portion forming mechanism and the concave ridge forming portion of the producing apparatus according to the embodiment of the present invention and the blank, and showing positions of the cross sections B, C, D.

FIG. 2I is an explanatory view showing a reason why occurrence of cracks at a portion "a" of the blank can be prevented by providing, to a bending die and the punch, the material-inflow-promoting-portion forming mechanism formed of a recessed portion and a projecting portion.

FIG. 2J(*a*) to FIG. 2J(*f*) are explanatory views showing examples of the shape of a constitutional element of various kinds of material-inflow-promoting-portion forming mechanism formed on the punch.

FIG. 3(*a*) is a plan view showing the shape of a blank before forming is performed, and FIG. 3(*b*) is a plan view showing the shape of the blank during a forming process.

FIG. 4 is a plan view showing a flow of material in the embodiment of the present invention.

FIG. 5(*a*) to FIG. 5(*d*) are explanatory views showing one example of a press tooling used in the present invention.

FIG. 6(*a*) to FIG. 6(*d*) are explanatory views showing another example of the press tooling used in the present invention.

FIG. 7(*a*) to FIG. 7(*d*) are explanatory views showing another example of the press tooling used in the present invention.

FIG. 8 is an exploded perspective view of the press tooling shown in FIG. 7.

FIG. 9(*a*) to FIG. 9(*c*) are a front view, a plan view, and a right side view each showing a pressed component formed in Comparative Examples 1 to 7 and Inventive Examples 1 to 7 of the present invention.

FIG. 10 is a plan view showing the shape of a blank used in the Comparative Examples 1 to 7 and the Inventive Examples 1 to 7 of the present invention.

FIG. 11 is a perspective view showing the configuration of a press tooling used in the Comparative Examples 1 to 7.

FIG. 12 is a plan view showing the shape of a blank used in Inventive Examples 8, 9 of the present invention.

FIG. 13(*a*) to FIG. 13(*c*) are a front view, a right side view, and a plan view each showing the shape of an intermediate formed product formed in the Inventive Examples 8, 9 of the present invention.

FIG. 14(*a*) to FIG. 14(*c*) are a front view, a right side view, and a plan view each showing the shape of a pressed component formed in the Inventive Examples 8, 9 of the present invention.

FIG. 15 is a perspective view showing the configuration of a press tooling for performing forming by the present invention in the Inventive Examples 8, 9 of the present invention.

FIG. 16 is a perspective view of one example of a frame member which has a hat-shaped cross section and has a straight line shape extending in a longitudinal direction as viewed in a plan view and in a side view.

FIG. 17 is an explanatory view of a front pillar which is a frame member having a hat-shaped cross section, wherein FIG. 17(*a*) is a perspective view, and FIG. 17(*b*) is a plan view.

FIG. 18 is a perspective view showing an L-shaped pressed component.

FIG. 19 is a perspective view showing the L-shaped pressed component produced by performing bend forming.

FIG. 20 is an explanatory view showing the L-shaped pressed component, wherein FIG. 20(*a*) is a perspective view, and FIG. 20(*b*) is a plan view.

FIG. 21 is a plan view showing the shape of a blank and a blank holder holding region of the blank for performing draw forming.

FIG. 22(*a*) to FIG. 22(*d*) are cross-sectional views showing the structure of a press tooling for performing draw forming and a process of the draw forming.

FIG. 23 is a perspective view of a drawn panel formed by performing draw forming.

FIG. 24 is a plan view for describing an inflow of material in performing draw forming.

DESCRIPTION OF EMBODIMENTS

One example of an L-shaped pressed component produced by the present invention, and one example of a method and an apparatus for producing an L-shaped pressed component according to the present invention are sequentially described.

1. L-Shaped Pressed Component 1

FIG. 18 exemplifies the shape of an L-shaped pressed component 1. The L-shaped pressed component 1 includes a hat-shaped cross section and a curved portion 1*a* which is curved into an L shape in a longitudinal direction as viewed in a plan view.

The hat-shaped cross section is defined by a top plate 11, vertical walls 12, 14, the concave ridges 16, 17, and flanges 13, 15. The vertical walls 12, 14 are connected to both sides of the top plate 11. The concave ridges 16, 17 are respectively connected to the vertical walls 12, 14. The flanges 13, 15 are respectively connected to the concave ridges 16, 17. The L-shaped pressed component 1 includes the curved portion 1*a*, thus having an L shape as viewed in a plan view.

The L-shaped pressed component 1 uses, as a starting material thereof, a blank formed of a high tensile strength steel sheet having a sheet thickness of 0.8 mm or more and 3.2 mm or less, and tensile strength of 590 MPa or more, and particularly, 1180 MPa or more and 1800 MPa or less. The high tensile strength steel sheet is generally used for an automobile frame member.

To ensure performance, such as strength, of the automobile frame member, tensile strength of a blank is 200 MPa or more, and is preferably 1800 MPa or less. Particularly, a blank having tensile strength of 500 MPa or more, preferably 590 MPa or more, and more preferably 1180 MPa or more allows a reduction in sheet thickness of the blank, thus reducing weight of the L-shaped pressed component 1.

In the case where any of these high tensile strength steel sheets is used for a blank, when the top plate 11 has an excessively large width as viewed in a plan view, in forming a vertical wall 14 and a flange 15 on the inner side of the curved portion 1*a*, inflow resistance of a blank 8 increases, thus causing insufficient inflow of the blank 8 to the inner side of the curved portion 1*a*. Accordingly, it is desirable that the width of the top plate 11 be 400 mm or less as viewed in a plan view. On the other hand, when the width of the top plate 11 is excessively small as viewed in a plan view, a pressurizing device for a pad 74, such as a gas cushion is required to reduce in size, thus preventing a pressurizing force from the pad 74 from being ensured. Accordingly, it is desirable that the width of the top plate 11 be 30 mm or more.

The extremely large projection distance of the vertical wall 12, 14 in a height direction of a product, which is the height of the vertical wall 12, 14 as viewed in a side view, increases inflow resistance of the blank 8 in forming the vertical wall 14, a concave ridge 17 and the flange portion 15 on the inner side of the curved portion 1*a*, thus causing insufficient inflow of the blank 8 to the inner side of the curved portion 1*a*. Accordingly, it is desirable that the height of the vertical wall 12, 14 be 300 mm or less.

It is desirable that the height of each of the vertical walls 12, 14 be 70 mm or more. This is because when the height of the vertical walls 12, 14 is less than 70 mm, the L-shaped pressed component 1 can be formed, without use of the present invention, by a forming method disclosed in Patent Document 3 without causing occurrence of cracks in a flange 15.

The extremely small radius of curvature of the concave ridge 16, 17 of the L-shaped pressed component 1 causes insufficient inflow of the blank 8 to the inner side of the curved portion 1*a* in forming the flange portion 15 on the inner side of the curved portion 1*a*. Accordingly, it is desirable that the radius of curvature of the concave ridge 16, 17 be 5 mm or more as viewed in a side view.

It is desirable that a radius of curvature of the vertical wall 14 on the inner side of the curved portion 1*a* be 100 mm or less as viewed in a plan view. This is because when the radius of curvature exceeds 100 mm, the L-shaped pressed component 1 can be formed, without use of the present invention, by the forming method disclosed in Patent Document 3 without causing occurrence of cracks in the flange 15.

It is desirable that the radius of curvature of the concave ridge 16, 17 be 10 mm or less. This is because when the radius of curvature of the concave ridge 17 exceeds 10 mm, the L-shaped pressed component 1 can be formed, without use of the present invention, by the forming method disclosed in Patent Document 3 without causing occurrence of cracks in the flange 15.

It is desirable that at least two or more of the followings be satisfied: that the blank 8 is formed of an ultrahigh tensile strength steel sheet having tensile strength of 1180 MPa or more; that a projection distance of the vertical wall 12, 14 in the height direction of a product, which is the height of the L-shaped pressed component 1, is 55 mm or more; that the radius of curvature of the concave ridge 16, 17 of the L-shaped pressed component 1 is 15 mm or less as viewed in a side view; or that the radius of curvature of the inner side of the curved portion 1*a* of the L-shaped pressed component 1 is 140 mm or less as viewed in a plan view. This is because when any one of or none of these conditions is satisfied, the L-shaped pressed component 1 can be formed, without use of the present invention, by the forming method disclosed in Patent Document 3 without causing occurrence of cracks in the flange 15.

Further, a sheet thickness reduction rate of the L-shaped pressed component 1: {(maximum value of sheet thickness−minimum value of sheet thickness)/maximum value of sheet thickness}×100 is 15% or less. There has been no L-shaped pressed component 1 having such a low sheet thickness reduction rate. The L-shaped pressed component 1 which is a structural member of a vehicle body of an automobile has a low sheet thickness reduction rate as described above. Accordingly, using, as a blank, a steel sheet having tensile strength of 200 MPa or more, preferably a high tensile strength steel sheet having tensile strength of 590 MPa or more, and more preferably an ultrahigh tensile strength steel sheet having tensile strength of 1180 MPa or more can reduce the sheet thickness of the blank, thus realizing reduction in weight of the L-shaped pressed component 1 having excellent collision safety performance. In practice, the tensile strength of the L-shaped pressed component 1 is 1800 MPa or less.

2. Method and Apparatus for Producing L-Shaped Pressed Component 1

FIG. 1(*a*) to FIG. 1(*e*) are cross-sectional views schematically showing the configuration of the producing apparatus and forming steps according to the embodiment of the present invention.

In the embodiment of the present invention, a press tooling shown in FIG. 1(*a*) to FIG. 1(*e*) is used for forming the L-shaped pressed component 1 by performing press forming on the blank 8.

The press tooling includes a punch 72 and a blank holder 73, and a pad 74, a die 71 and a bending die 75 which are disposed so as to oppose the punch 72 and the blank holder 73.

The punch 72 has a shape including respective shapes on the back surface side in the sheet thickness direction of the top plate 11 of the L-shaped pressed component 1, the vertical wall 14, the concave ridge 17 and the flange 15 on the inner side of the curved portion 1*a*.

The blank holder 73 has a shape including shapes on the back surface side in the sheet thickness direction of a vertical wall 12, a concave ridge 16 and a flange 13 on the outer side of the curved portion 1*a*.

The pad 74 has a shape including a shape on the front surface side in the sheet thickness direction of the top plate 11 so as to oppose the blank holder 73.

The die 71 has a shape including respective shapes on the front surface side in the sheet thickness direction of the vertical wall 12 and the flange 13 on the outer side of the curved portion 1*a*.

Further, the bending die 75 has a shape including respective shapes on the front surface side in the sheet thickness direction of the vertical wall 14, the concave ridge 17, and the flange 15 on the inner side of the curved portion 1*a*.

FIG. 2(*a*) to FIG. 2(*e*) are cross-sectional views showing the configuration of another press tooling and forming steps according to the embodiment of the present invention.

A point which makes the press tooling shown in FIG. 2(*a*) to FIG. 2(*e*) different from the press tooling shown in FIG. 1 lies in that a locking mechanism 76 described later is mounted on the punch 72.

The locking mechanism 76 is formed of a pin disposed so as to freely enter and withdraw from the punch 72. The locking mechanism 76 is completely accommodated in the punch 72 from the start of forming to the forming bottom dead center (FIG. 2(*a*) to FIG. 2(*c*)). The locking mechanism 76 moves and projects to the blank holder 73 side at the forming bottom dead center shown in FIG. 2(*d*) so as to fix the blank holder 73 to the punch 72.

In releasing a press tooling, the locking mechanism 76 allows the die 71, the pad 74 and the bending die 75 to elevate in a state where the locking mechanism 76 fixes the blank holder 73 to the punch 72 so as to release the press tooling. In this manner, the locking mechanism 76 prevents the formed L-shaped pressed component 1 from being damaged by a pressurizing force from the pad 74.

As the locking mechanism 76, a mechanism may be used which allows a press tooling to release in a state where the locking mechanism 76 fixes (holds) the positional relationship between the pad 74, the bending die 75 and the die 71 (drawing die) at the forming bottom dead center after the forming is completed. For example, the following configurations are exemplified.

(a) A press tooling is released in a state where the mechanism fixes the pad 74 to the bending die 75 and the mechanism fixes the die 71 (drawing die) to the pad 74 or to the bending die 75.

(b) A press tooling is released in a state where a spacer is inserted so as to fix a distance between the blank holder 73 and the pad 74 at the forming bottom dead center.

(c) A press tooling is released in a state where the mechanism fixes (holds) the positional relationship between the pad 74 and the die 71 (drawing die) at the forming bottom dead center.

A blank is formed into the L-shaped pressed component 1 using the press tooling.

In the case where a body of a press machine can perform control of stopping the elevation of a cushion pin of the press machine, which is to be connected to the blank holder 73, for example, the elevation of the blank holder 73 can be stopped. Accordingly, in such a case, the locking mechanism 76 may not be provided to the press tooling, such as the punch 72.

FIG. 2A is an explanatory view partially showing an example of the configuration of a producing apparatus 20 according to the embodiment of the present invention. In FIG. 2A to FIG. 2J, for the sake of convenience in description, constitutional elements of the press tooling and a blank are given symbols which are different from symbols given in FIGS. 1, 2. However, the constitutional elements of the press tooling and the blank in FIG. 2A to FIG. 2J are identical to the constitutional elements of the press tooling and the blank in FIGS. 1, 2.

As shown in FIG. 2A, the producing apparatus 20 includes a bending die 21, a die 22, a blank holder 27, and a punch 23 which is disposed so as to oppose the bending die 21 and the die 22.

The producing apparatus 20 performs cold or hot press working on a blank 24 or a preformed blank (the illustration being omitted) disposed between the die 22, the bending die 21, and a die pad 26 on one side and the punch 23 and the blank holder 27 on the other side, thus producing the L-shaped pressed component 1 having an external shape shown in FIG. 18, or an intermediate formed product 1-1 of the L-shaped pressed component 1. In this specification, "intermediate formed product" means a press formed product before a material inflow promoting portion described later is removed. Removing unnecessary portions, such as the material inflow promoting portion, from the intermediate formed product allows an L-shaped press formed product to be acquired.

The producing apparatus 20 is preferably used when the condition 1 or 2 is satisfied. The reason is as follows. Performing second working disclosed in Patent Document 3 with the condition 1 or 2 satisfied causes occurrence of cracks in the flange 15 on the inner side of the curved portion 1*a* of the L-shaped pressed component 1 to be acquired. Accordingly, high efficacy of using the producing apparatus 20 can be acquired in such a case.

FIG. 2B is an explanatory view partially showing one example of the intermediate formed product 1-1 formed by performing press forming with the producing apparatus 20. FIG. 2C is an explanatory view showing the positional relationship between a material-inflow-promoting-portion forming mechanism 25 and a concave ridge forming portion 23*b* of the producing apparatus 20 and the blank 24.

The producing apparatus 20 performs press working by bend forming according to the second step disclosed in Patent Document 3. In addition to the above, as shown in FIGS. 2A, 2C, a recessed portion 21*a* and a projecting portion 23*a* are respectively formed on the bending die 21 and the punch 23 as the material-inflow-promoting-portion forming mechanism 25 for forming a material inflow promoting portion 19 on the blank 24. As described above, the material-inflow-promoting-portion forming mechanism 25 is formed of the recessed portion 21*a* formed on the bending die 21 and the projecting portion 23*a* formed on the punch 23.

As shown in FIG. 2B, in performing press working by bend forming according to the second step disclosed in Patent Document 3, the producing apparatus 20 forms, in a side by side manner, the material inflow promoting portion 19 in the vicinity of a portion of the blank 24 to be formed into the flange 15 on the inner side of the curved portion 1*a* of the L-shaped pressed component 1.

As shown in FIGS. 2B, 2C, it is desirable that the material-inflow-promoting-portion forming mechanism 25 forms the material inflow promoting portion 19 on the blank 24 in a region outside a region (a hatched region in FIG. 2C) to be formed into the L-shaped pressed component 1. Forming the material inflow promoting portion 19 in such a region prevents the trace of the material inflow promoting portion 19 from remaining on the L-shaped pressed component 1.

However, in the case where the trace of the material inflow promoting portion 19 is allowed to remain on the L-shaped pressed component 1, the material inflow promoting portion 19 may be formed on a portion of the blank 24 inside a region (a hatched region in FIG. 2C) to be formed into the L-shaped pressed component 1.

Next, the material-inflow-promoting-portion forming mechanism 25 is described in detail.

FIG. 2D is an explanatory view showing a cross section of the conventional punch 23-1, provided with no material-inflow-promoting-portion forming mechanism 25, which corresponds to a cross section A-A in FIG. 2A.

FIG. 2E is an explanatory view showing the positional relationship between the material-inflow-promoting-portion forming mechanism 25 and the concave ridge forming portion 23*b* of the producing apparatus 20 and the blank 24, and showing positions of the cross sections B, C, D.

FIG. 2F is a graph showing a difference in cross-sectional peripheral length on the cross sections B, C, D of a flange forming portion of the punch 23 with respect to a conventional punch. In the graph of FIG. 2F, cross sections B, C, D in a conventional method are shown on the left side, and cross sections B, C, D in the embodiment of the present invention are shown on the right side. Cross sections below the graph in FIG. 2F show shapes of the blank 24 on the cross sections B, C, D.

Further, FIG. 2G shows the cross section A-A of the punch 23 provided with the material-inflow-promoting-portion forming mechanism 25.

In the case where the condition 1 or 2 is satisfied, when press working is performed on the blank 24 by second working of forming the vertical wall 14 on an inner circumference side of the curved portion 1*a* using a conventional punch 23-1, cracks occur at a portion "a" shown in FIG. 2D.

As shown in FIGS. 2E, 2F, in the embodiment of the present invention, with the provision of the material-inflow-promoting-portion forming mechanism 25, which is formed of the recessed portion 21*a* formed on the bending die 21 and the projecting portion 23*a* formed on the punch 23, the material inflow promoting portion 19 is formed on the intermediate formed product 1-1 formed by performing press forming.

The material inflow promoting portion 19 is formed such that the cross-sectional peripheral lengths on the cross sections B, C, D gradually increase as a distance from an inner surface of the curved portion 1*a* increases. In this embodiment, the cross sections B, C, D are cross sections arranged in this order in a direction separating from the flange 15 on the inner side of the curved portion 1*a* of the L-shaped pressed component 1. Each of the cross sections B, C, D extends parallel to a straight line which is in contact with a center position (portion "a") in a curved circumferential direction on the inner side of the curved portion 1*a* as viewed in a plan view from a direction orthogonal to the top plate 11, and extends along a direction orthogonal to the top plate (cross section in a direction of material inflow: cross section in the direction of maximum principal strain of the deformation of the flange 15 on the inner side of the curved portion 1*a* of the L-shaped pressed component 1). This center position is not limited to an exact center position, and it is sufficient that the center position falls within a predetermined region including the exact center position in the curved circumferential direction.

The cross sectional shapes of the material inflow promoting portion 19 are not limited to shapes where cross-sectional peripheral lengths monotonically increase as a distance from the flange 15 on the inner side of the curved portion 1*a* of the L-shaped pressed component 1 increases. The cross sectional shapes may partially have a constant cross-sectional peripheral length.

As shown in FIG. 2F, compared to a conventional method, where the material-inflow-promoting-portion forming mechanism 25 is not provided, in the embodiment of the present invention, a difference in cross-sectional peripheral length of the flange forming portion of the punch 23 with respect to the conventional punch increases on all of the cross sections B, C, D.

Further, in the embodiment of the present invention, the material-inflow-promoting-portion forming mechanism 25 is provided such that a difference in cross-sectional peripheral length on the cross section C is larger than a difference in cross-sectional peripheral length on the cross section B, and a difference in cross-sectional peripheral length on the cross section D is larger than a difference in cross-sectional peripheral length on the cross section C.

In other words, in the embodiment of the present invention, the material-inflow-promoting-portion forming mechanism 25 has a shape which causes differences in cross sectional line length (inflow amounts) on the cross sections B, C, D to increase, and the material-inflow-promoting-portion forming mechanism 25 is provided on the bending die 21 and the punch 23 in the form of the recessed portion 21*a* and the projecting portion 23*a*.

The material inflow promoting portion 19 is exemplified as follows. As shown in FIG. 2G, for example, on a vertical cross section including a straight line orthogonal to, in a horizontal plane, a straight line which is in contact with the center position on the inner side of the curved portion 1*a* in a state where the second step is finished, the material inflow promoting portion 19 is formed to have an external shape obtained by connecting a part of the blank 24 to be formed into a meeting point between the concave ridge 17 and the flange 15 on the inner side of the curved portion 1*a* and an edge portion 24*a* of the blank 24.

FIG. 2H is an explanatory view showing the positional relationship between the material-inflow-promoting-portion forming mechanism 25 and the concave ridge forming portion 23*b* of the producing apparatus 20 and the blank 24, and showing positions of the cross sections B, C, D.

As has been described above, a variation difference in inflow amount of material made to flow in by the material-inflow-promoting-portion forming mechanism 25 (which means an increased amount of inflow in FIG. 2F (an amount of increase in inflow amount when the method of the present invention is used with respect to an inflow amount when the conventional method, where a material-inflow-promoting-portion forming mechanism is not provided, is used)) increases as a distance from the portion "a" of the blank 24 increases as indicated by a bold arrow in FIG. 2H (cross section B cross section C=cross section D). A variation difference at the portion "a" of the blank 24 facilitates occurrence of cracks and hence, it is almost unnecessary to provide a variation difference at the portion "a" of the blank 24. A region where a variation difference in inflow amount of material is provided may be set up to the position of the end edge of the blank 24 before forming is performed as viewed in a plan view.

Next, the function of the material-inflow-promoting-portion forming mechanism 25 is described.

FIG. 2I is an explanatory view showing a reason why occurrence of cracks at the portion "a" of the blank 24 can be prevented by providing, to the bending die 21 and the punch 23, the material-inflow-promoting-portion forming mechanism 25 formed of the recessed portion 21*a* and the projecting portion 23*a*.

Cracks at the portion "a" of the blank 24 are caused by a high tension F in the blank 24 in the circumferential direction of the concave ridge 17 disposed at a position on the portion "a". In the embodiment of the present invention, press working is performed in a state where the material-inflow-promoting-portion forming mechanism 25 is provided and hence, an inflow amount of material flowing into a portion outward the portion "a" is increased. For this reason, an inflow amount of material from the periphery of the portion "a" increases, thus increasing an inflow amount of material flowing into the portion "a".

That is, the material-inflow-promoting-portion forming mechanism 25 increases an inflow amount of material flowing into a portion of the blank 24 to be formed into the curved portion 1*a*. Accordingly, although a direction of main stress of deformation at this portion does not significantly change, an amount of deformation at this portion is reduced.

In this manner, compared to the case where the material-inflow-promoting-portion forming mechanism 25 is not provided, an inflow amount of material flowing into the portion of the blank 24 to be formed into the flange 15 on the inner side of the curved portion 1*a* of L-shaped pressed component 1 is increased.

Accordingly, tension F in the blank 24 in the circumferential direction of the concave ridge 17 disposed at a position on the portion "a" is reduced. Therefore, a deformation load applied to a portion of the blank 24 to be formed into the curved portion 1*a* is reduced, thus preventing cracks at the portion "a" of the blank 24.

FIG. 2J(*a*) to FIG. 2J(*f*) are explanatory views showing examples of the shape of a constitutional element of various kinds of material-inflow-promoting-portion forming mechanism 25 formed on the punch 23.

As the projecting portion 23*a* which is a constitutional element of the material-inflow-promoting-portion forming mechanism 25 to be provided to the punch 23, as shown in FIG. 2J(*a*), a projecting portion may be used which is described with reference to FIG. 2G, and which projects toward the direction of the top plate 11 of the L-shaped pressed component 1.

As shown in FIG. 2J(*b*), in place of the projecting portion 23*a* shown in FIG. 2J(*a*), a recessed portion 23*c* may be used which projects toward the direction opposite to the top plate 11 of the L-shaped pressed component 1. In this case, it is needless to say that a projecting portion which corresponds to the recessed portion 23*c* is formed on the bending die 21.

When the blank 24 is small in size, as shown in FIG. 2J(*c*), it is sufficient to form the projecting portion 23*a* in a range which allows the blank 24 to come into contact with the projecting portion 23*a*.

Further, as shown in FIG. 2J(*d*) and as described above, in the case where a the trace of the material inflow promoting portion 19 is allowed to remain on the L-shaped pressed component 1, the projecting portion 23*a* may be formed such that the material inflow promoting portion 19 is provided so as to extend to the inside of a region (hatched region in FIG. 2C) of the blank 24 to be formed into the L-shaped pressed component 1.

As shown in FIG. 2J(e), two or more projecting portions 23*a* may be provided.

Further, as shown in FIG. 2J(f), the projecting portion 23*a* may be formed in a stepped manner in a direction parallel to the sheet thickness direction of a blank 24.

As described above, the material-inflow-promoting-portion forming mechanism 25 forms one, two or more material inflow promoting portions 19. The material inflow promoting portion 19 increases an inflow amount of material flowing into a portion of the blank 24 to be formed into the flange 15 on the inner side of the curved portion 1*a* of the L-shaped pressed component 11 at a portion of the blank 24 to be formed into an end portion 1*b* of the L-shaped pressed component 1 in the longitudinal direction.

In FIG. 2J(*a*) to FIG. 2J(*f*), to clearly show the constitutional elements, the projecting portion 23*a* and the recessed portion 23*c* having edges are shown. However, it is needless to say that, in an actual apparatus, the edges of the projecting portion 23*a* and the recessed portion 23*c* may have a smooth round (curved) shape so as not to prevent the inflow of material.

The L-shaped pressed component 1 which is to be produced by the embodiment of the present invention satisfies the above-mentioned condition 1 or 2. When the conventional method described in Patent Document 3 is used, cracks occur at the portion "a".

FIG. 3(*a*) is a plan view showing the shape of the blank 8 before forming is performed, and FIG. 3(*b*) is a plan view showing the shape of the blank 8 during a forming process. Further, FIG. 4 is a plan view showing a flow of material in the embodiment of the present invention. In FIGS. 3, 4, the material inflow promoting portion 19 and the material-inflow-promoting-portion forming mechanism 25 are omitted.

As shown in FIG. 1(*a*), the blank 8 having a shape shown in FIG. 3(*a*) is disposed between the punch 72 and the blank holder 73 on one side and the pad 74, the die 71 and the bending die 75 on the other side.

Next, as shown in FIG. 1(*b*), a portion of the blank 8 to be formed into the top plate 11 is pressurized and held in a state of being clamped by the pad 74 and the punch 72. At the same time, a portion of the blank 8 to be formed into a portion disposed further outward of the curved portion 1*a* than the portion of the blank 8 to be formed into the top plate 11 is pressurized and held in a state of being clamped by the blank holder 73 and the die 71.

Next, as shown in FIG. 1(*c*), the bending die 75 is relatively moved in a direction toward a side where the punch 72 is disposed so as to perform working on the blank 8, thus forming the vertical wall 14, the concave ridge 17 and the flange 15 on the inner side of the curved portion 1*a*. With such an operation, the blank 8 is formed into a shape shown in FIG. 3(*b*).

At this point of operation, the blank 8 is pulled only from the inner side of the curved portion 1*a* so that a portion of the blank 8, which is clamped between the punch 72 and the blank holder 73 on one side and the pad 74 and the die 71 on the other side, also flows into the inner circumference side of the curved portion 1*a*, and forming is performed.

Accordingly, unlike the draw forming where the curved portion 1*a* is pulled from both of the outer side and the inner side of the curved portion 1*a* (see FIG. 24), as shown in FIG. 4, at a flange (portion "D") on the inner side of the curved portion 1*a*, the blank 8 does not significantly move from the inner side to the outer side of the curved portion 1*a* during the forming process. Further, a distal end of the blank 8 in the longitudinal direction flows into the inner side of the curved portion 1*a* so as to bend the entire blank 8. The flange 15 on the inner side of the curved portion 1*a* (portion "D") which is disposed on the inner side of the bending is compressed. Accordingly, an amount of stretch of the flange 15 on the inner side of the curved portion 1*a* (portion "D") at the time of performing forming is remarkably reduced compared to draw forming.

Further, as shown in FIG. 1(*d*), after the vertical wall 14, the concave ridge 17 and the flange 15 on the inner side of the curved portion 1*a* are formed, with the blank 8 pressurized and held in a state of being clamped by the blank holder 73 and the die 71, the die 71 and the blank holder 73 are moved relative to the blank 8 in a direction toward a side where the blank holder 73 is disposed so as to perform working on the blank 8, thus forming the vertical wall 12, the concave ridge 16 and the flange 13 on the outer side of the curved portion 1*a*. The L-shaped pressed component 1 shown in FIG. 18 is formed in this manner.

At this point of operation, during a forming process for the vertical wall 14 and the flange 15 on the inner side of the curved portion 1*a*, a portion to be formed into the top plate 11 and a portion to be formed into the flange 13 also flow into the inner side of the curved portion 1*a*, thus bringing about a state where the blank 8 contracts in the longitudinal direction, and a compressive stress remains. Accordingly, a corner portion (portion "C" in FIG. 4) forming a meeting portion between the vertical wall 12 on the outer side of the curved portion 1*a* and the top plate 11, which is significantly stretched during a forming process, is also formed into a shape bulging outward from a state where a compressive stress remains.

Accordingly, compared to draw forming where forming is performed from a state having no compressive stress, required ductility of a material is reduced. As a result, even when a high strength material (for example, high tensile strength steel sheet having tensile strength of 590 MPa or more) having low ductility is used for the blank 8, forming can be preferably performed on the blank 8 while occurrence of cracks is suppressed.

In forming the vertical wall 14 and the flange 15 on the inner side of the curved portion 1*a*, the vertical wall 14 and the flange 15 are formed by bending with the bending die 75 and hence, it is unnecessary to provide a blank holder holding region to an inner peripheral portion of the curved portion 1*a* and to a distal end portion in the longitudinal direction. Accordingly, the blank 8 can be reduced in size, thus realizing formation at high material yield rate.

Further, as shown in FIG. 2A to 2C, performing press working with the material-inflow-promoting-portion forming mechanism 25, formed on the bending die 21 and the punch 23, allows the intermediate formed product 1-1 to have at least one material inflow promoting portion 19, which increases an inflow amount of material flowing into a portion to be formed into the flange 15 on the inner side of the curved portion 1*a*.

Therefore, as described with reference to FIG. 21, the embodiment of the present invention can increase an inflow amount of material flowing into the portion of the blank 24 to be formed into the flange 15 on the inner side of the curved portion 1*a* of the L-shaped pressed component 1. Accordingly, tension F in the blank 24 in the circumferential direction of the concave ridge 17 disposed at a position on the portion "a" can be reduced and hence, cracks at the portion "a" of the blank 24 can be prevented.

Finally, as shown in FIG. 1(*e*), in taking out the formed L-shaped pressed component 1 from the inside of the press tooling after forming of the L-shaped pressed component 1 is completed, the blank holder 73 is fixed to the punch 72 by the locking mechanism 76, for example, so as to prevent the relative movement.

Then, in a state where the blank holder 73 is prevented from pressurizing by pressing the formed L-shaped pressed component 1 against the die 71, the pad 74, the die 71 and the bending die 75 are separated from the blank holder 73 and the punch 72 so as to take out the L-shaped pressed component 1. With such an operation, the formed intermediate formed product 1-1 can be taken out without being deformed and damaged by the pressurized pad 74 and the blank holder 73.

Thereafter, an unnecessary portion, which remains at a part of the periphery of the intermediate formed product 1-1 take out, and which includes an entire or a part of the material inflow promoting portion 19, is removed using a proper removing device (for example, a device which is commonly used as a removing device of this kind, such as a cutting device), thus producing the L-shaped pressed component 1 having a desired shape and high strength.

The schematic configuration of the apparatus for producing the L-shaped pressed component 1 has been described heretofore. The structure of the press tooling is described in more detail.

FIG. 5(*a*) to FIG. 5(*d*) are explanatory views showing one example of the press tooling used in the present invention. The locking mechanism 76 is omitted in FIGS. 5 to 7.

With respect to the press tooling, each of the bending die 75, the die (drawing die) 71, and the pad 74 is directly supported by a die base 77 and is individually driven with respect to the die base 77. The press tooling does not use a frame or the like which supports the bending die 75 and a drawing die 71 and hence, the press tooling can be reduced in size as a whole.

FIG. 6(*a*) to FIG. 6(*d*) are explanatory views showing another example of the press tooling used in the present invention.

The press tooling has a structure where a sub-base 78 holds a pad 74 and a die 71 (drawing die). Eccentric loads of the pad 74 and the die 71 (drawing die) are received by sub-base 78, which is an integral body with a bending die and hence, deformation of the press tooling can be suppressed compared to the press tooling shown in FIG. 5(*a*) to FIG. 5(*d*).

FIG. 7(*a*) to FIG. 7(*d*) are explanatory views showing another example of the press tooling used in the present invention, and FIG. 8 is an exploded perspective view of the press tooling.

With respect to the press tooling, a pad 74 is incorporated not in a sub-base 78 but instead in a die base 77, thus avoiding a load of the pad 74 being applied to the sub-base 78. The sub-base receives a load in the vertical direction only from a bending die, which is an integral body with the sub-base and hence, deformation of the sub-base of the press tooling can be suppressed compared to the press tooling shown in FIG. 6(*a*) to FIG. 6(*d*).

Any of the press tooling exemplified in FIG. 5(*a*) to FIG. 5(*d*), FIG. 6(*a*) to FIG. 6(*d*), and FIG. 7(*a*) to FIG. 7(*d*) is a press tooling having a structure particularly effective in carrying out the producing method according to the present invention. However, the structure for suppressing deformation of the press tooling is affected by the cost or size of the press tooling. Accordingly, which structure of a press tooling to be used may be suitably decided by taking into account size or shape of a component to be produced and, further, strength of a blank to be used or the like so as to take rigidity required for the press tooling into consideration.

EXAMPLE

FIG. 9(*a*) to FIG. 9(*c*) are a front view, a plan view, and a right side view each showing a pressed component 1 to be formed in Comparative Examples 1 to 7 and Inventive Examples 1 to 7 of the present invention. FIG. 10 is a plan view showing the shape of a blank 8 used in the Comparative Examples 1 to 7 and the Inventive Examples 1 to 7 of the present invention. Further, FIG. 11 is a perspective view showing the configuration of a press tooling used in the Comparative Examples 1 to 7.

Results of the Comparative Examples 1 to 7 and the Inventive Examples 1 to 9 of the present invention are collectively shown in Table 1.

TABLE 1

| | Blank tensile strength (TS) MPa | Blank sheet thickness (mm) | Product height H (mm) | Radius of curvature $R_1$ of concave ridge (mm) | Radius of curvature $R_2$ of curved portion on the inner side (mm) | Presence or absence of material inflow promoting portion | Difference in cross-sectional peripheral length on inner periphery of curve in FIG. 2E | Formed state |
|---|---|---|---|---|---|---|---|---|
| Comparative Example 1 | 1180 | 1.2 | 70 | 20 | 145 | absent | — | X |
| Comparative Example 2 | 1180 | 1.2 | 50 | 10 | 145 | absent | — | X |

TABLE 1-continued

| | Blank tensile strength (TS) MPa | Blank sheet thickness (mm) | Product height H (mm) | Radius of curvature $R_1$ of concave ridge (mm) | Radius of curvature $R_2$ of curved portion on the inner side (mm) | Presence or absence of material inflow promoting portion | Difference in cross-sectional peripheral length on inner periphery of curve in FIG. 2E | Formed state |
|---|---|---|---|---|---|---|---|---|
| Comparative Example 3 | 1180 | 1.2 | 50 | 20 | 100 | absent | — | X |
| Comparative Example 4 | 1180 | 1.2 | 55 | 15 | 140 | absent | — | X |
| Comparative Example 5 | 1180 | 1.2 | 60 | 15 | 145 | absent | — | X |
| Comparative Example 6 | 1180 | 1.2 | 50 | 15 | 135 | absent | — | X |
| Comparative Example 7 | 1180 | 1.2 | 65 | 20 | 135 | absent | — | X |
| Inventive Example 1 | 1180 | 1.2 | 70 | 20 | 145 | present | B < C < D | ○ |
| Inventive Example 2 | 1180 | 1.2 | 50 | 10 | 145 | present | B < C < D | ○ |
| Inventive Example 3 | 1180 | 1.2 | 50 | 20 | 100 | present | B < C = D | ○ |
| Inventive Example 4 | 1180 | 1.2 | 55 | 15 | 140 | present | B < C < D | ○ |
| Inventive Example 5 | 1180 | 1.2 | 60 | 15 | 145 | present | B < C < D | ○ |
| Inventive Example 6 | 1180 | 1.2 | 50 | 15 | 135 | present | B < C < D | ○ |
| Inventive Example 7 | 1180 | 1.2 | 65 | 20 | 135 | present | B < C < D | ○ |
| Inventive Example 8 | 1470 | 1.2 | 60 | 15 | 100 | present | B < C < D | ○ |
| Inventive Example 9 | 1180 | 1.2 | 80 | 15 | 120 | present | B < C < D | ○ |

In each of the Comparative Examples 1 to 7 and the Inventive Examples 1 to 7 of the present invention, the L-shaped pressed component 1 having the shape shown in FIG. 9(*a*) to FIG. 9(*c*) was produced using, as a blank, a high tensile strength steel sheet having tensile strength of 1180 MPa, and a sheet thickness of 1.2 mm by a draw forming method, which is prior art, or the method of the present invention as a producing method.

In the formed state in Table 1, "O" indicates no occurrence of cracks, and "x" indicates occurrence of cracks or occurrence of necking.

In the Comparative Examples 1 to 7, a draw forming method was used which uses a blank having tensile strength of 1180 MPa. Cracks occurred in each of the Comparative Examples 1 to 7 so that the L-shaped pressed component 1 having the shape shown in FIG. 9(*a*) to FIG. 9(*c*) was not formed. On the other hand, in the Inventive Examples 1 to 7 of the present invention, the L-shaped pressed component 1 was able to be preferably formed without causing occurrence of cracks also in the case where a blank having tensile strength of 1180 MPa was used.

FIG. 12 is a plan view showing the shape of a blank used in the Inventive Examples 8, 9 of the present invention. FIG. 13(*a*) to FIG. 13(*c*) are a front view, a right side view, and a plan view each showing the shape of an intermediate formed product formed in Inventive Examples 8, 9 of the present invention. FIG. 14(*a*) to FIG. 14(*c*) are a front view, a right side view, and a plan view each showing the shape of the pressed component 1 formed in the Inventive Examples 8, 9 of the present invention. FIG. 15 is a perspective view showing one example of the configuration of a press tooling for performing forming by the present invention in the Inventive Examples 8, 9 of the present invention.

The Inventive Examples 8, 9 of the present invention are examples where a complicated shape shown in FIG. 14(*a*) to FIG. 14(*c*) was formed using, as a blank, a high strength steel sheet having low ductility, tensile strength of 1180 or 1470 MPa, and a sheet thickness of 1.2 mm.

The blank having the shape shown in FIG. 12 was formed into an intermediate formed product having the shape shown in FIG. 13(*a*) to FIG. 13(*c*) using a press tooling having the configuration shown in FIG. 15 and, further, post processing was applied to the intermediate formed product. As a result, the pressed component 1 having the shape shown in FIG. 14(*a*) to FIG. 14(*c*) was able to be preferably formed without causing occurrence of cracks and wrinkles.

The invention claimed is:

1. A method for producing a pressed component by performing press working on a blank disposed between a punch and a blank holder on one side and a pad, a die and a bending die on another side, the pressed component having a top plate extending in the longitudinal direction, two vertical walls connected to a respective side of the top plate, two concave ridges respectively, connected to the two vertical walls, and two flanges respectively connected to the two concave ridges, and also having a curved portion at which the top plate, the two vertical walls and the two concave ridges are curved as viewed in a plan view from a direction orthogonal to the top plate, wherein the method comprises:

a first step of holding a portion of the blank to be formed into the top plate in a state of being clamped by the pad and the punch, and holding a portion of the blank to be formed into a portion disposed further outward of the curved portion than the portion of the blank to be formed into the top plate in a state of being clamped by the blank holder and the die;

a second step of relatively moving, after the first step, the bending die in a direction toward a side where the punch is disposed so as to perform the press working on the blank by bend forming, thus forming one of the two vertical walls, one of the two concave ridges connected to the one of the two vertical walls, and one of the two flanges connected to the one of the two concave ridges, which are to be disposed on an inner side of the curved portion; and a third step of relatively moving, after the second step, the die and the blank holder in a direction toward a side where the punch is disposed with the blank held in a state of being clamped by the blank holder and the die so as to perform the press working on the blank by draw forming, thus forming another one of the two vertical walls, another one of the two concave ridges connected to the another one of the two vertical walls, and another one of the two flanges connected to the another one of the two concave ridges, which are disposed on an outer side of the curved portion, wherein in the second step, one or more material inflow promoting portion is formed in a portion of the blank to be formed into a region disposed on the inner side of the curved portion; and the material inflow promoting portion is formed so as to protrude toward a same side as the top plate or protrude toward an opposite side to the top plate.

2. The method for producing a pressed component according to claim 1, wherein:

at least one of the following is satisfied: that the blank is formed of an ultrahigh tensile strength steel sheet having tensile strength of 1180 MPa or more; that a projection distance of the vertical walls in a height direction of a product, which is a height of the pressed component, is 70 mm or more; that a radius of curvature of the concave ridge of the pressed component is 10 mm or less as viewed in a side view; or that a radius of curvature of the curved portion of the pressed component on the inner side is 100 mm or less as viewed in the plan view; or at least two or more of the following are satisfied: that the blank is formed of an ultrahigh tensile strength steel sheet having tensile strength of 1180 MPa or more; that a projection distance of the vertical walls in a height direction of a product, which is a height of the pressed component, is 55 mm or more; that a radius of curvature of the concave ridge of the pressed component is 15 mm or less as viewed in a side view; or that a radius of curvature of the curved portion of the pressed component on the inner side is 140 mm or less as viewed in the plan view.

3. The method for producing a pressed component according to claim 1, wherein the material inflow promoting portion is formed on the blank in a region outside a region to be formed into the pressed component.

4. The method for producing a pressed component according to claim wherein:

the one of the two concave ridges has a curved region that is included in the curved portion, and a radius of curvature on an inner circumference of the curved region is 140 mm or less in the plan view, and further wherein when a straight line which is in contact with a center position of the inner circumference of the curved region in the plan view is defined as a reference line, and a length of a centerline in a sheet thickness direction of the material inflow promoting portion in a cross-section that is parallel to the reference line in the plan view is defined as a cross-sectional line length, the material inflow promoting portion has a region in which the cross-sectional line length increases as a distance from the center position increases in the plan view.

5. The method for producing a pressed component according to claim 1, wherein the material inflow promoting portion is a projecting bead or a concave bead, the projecting bead projecting in a direction from the flange toward the top plate in a direction along which the flange and the top plate are arranged, the concave bead projecting in a direction from the top plate toward the flange in the direction along which the flange and the top plate are arranged.

6. The method for producing a pressed component according to claim 1, wherein cross-sectional peripheral lengths of the material inflow promoting portion increase in a stepwise manner.

7. The method for producing a pressed component according to claim 4, wherein the material inflow promoting portion has a region in which the cross-sectional line length is constant at positions having different distances from the center position in the plan view.

8. The method for producing a pressed component according to claim 1 comprising a following fourth step after the third step, the fourth step where an unnecessary portion is removed which remains at a part of a periphery of a formed product acquired in the third step, and which includes an entire or a part of the material inflow promoting portion.

* * * * *